US008199068B2

(12) United States Patent
Williams et al.

(10) Patent No.: US 8,199,068 B2
(45) Date of Patent: Jun. 12, 2012

(54) SINGLE PLANE SPANNING MODE ACROSS INDEPENDENTLY DRIVEN DISPLAYS

(75) Inventors: David C. Williams, Carson City, NV (US); Kurt M. Larsen, Reno, NV (US); Joseph R. Hedrick, Reno, NV (US)

(73) Assignee: IGT, Reno, NV (US)

( * ) Notice: Subject to any disclaimer, the term of this patent is extended or adjusted under 35 U.S.C. 154(b) by 672 days.

(21) Appl. No.: 11/938,632

(22) Filed: Nov. 12, 2007

(65) Prior Publication Data

US 2008/0136741 A1 Jun. 12, 2008

Related U.S. Application Data

(60) Provisional application No. 60/858,741, filed on Nov. 13, 2006, provisional application No. 60/986,995, filed on Nov. 9, 2007.

(51) Int. Cl.
*G09G 5/00* (2006.01)

(52) U.S. Cl. ..... 345/6; 345/419

(58) Field of Classification Search ..... 345/1.3–3.4, 345/5, 6, 204, 419, 629–641; 463/20, 25, 463/29, 32

See application file for complete search history.

(56) References Cited

U.S. PATENT DOCUMENTS

| | | | |
|---|---|---|---|
| 3,708,219 | A | 1/1973 | Forlini et al. |
| 4,333,715 | A | 6/1982 | Brooks |
| 4,517,558 | A | 5/1985 | Davids |
| 4,574,391 | A | 3/1986 | Morishima |
| 4,607,844 | A | 8/1986 | Fullerton |
| 4,621,814 | A | 11/1986 | Stephen et al. |
| 4,659,182 | A | 4/1987 | Aizawa |
| 4,718,672 | A | 1/1988 | Okada |
| 4,911,449 | A | 3/1990 | Dickinson et al. |
| 4,912,548 | A | 3/1990 | Shanker et al. |
| 5,086,354 | A | 2/1992 | Bass et al. |
| 5,113,272 | A | 5/1992 | Reamey |
| 5,132,839 | A | 7/1992 | Travis |

(Continued)

FOREIGN PATENT DOCUMENTS

| | | |
|---|---|---|
| AU | 721968 | 7/2000 |

(Continued)

OTHER PUBLICATIONS

Microsoft, "Pointer_Ballistics.pdf", Oct. 31, 2002.*

(Continued)

*Primary Examiner* — Amare Mengistu
*Assistant Examiner* — Dmitriy Bolotin
(74) *Attorney, Agent, or Firm* — Weaver Austin Villeneuve & Sampson LLP

(57) ABSTRACT

A multi-layer display device having a first display screen having a first resolution and adapted to present a first visual image thereon, a second display screen having a second resolution and adapted to present a second visual image thereon, and a logic device configured to communicate with the first display screen and the second display screen and configured to receive a combined single plane visual image for display on the first and second display screen, the combined visual image having a first portion corresponding to the first visual image to be displayed on the first display screen and a second portion corresponding to the second visual image to be displayed on the second display screen, wherein the logic device is configured to transmit the first visual image to the first display screen and the second visual image to the second display screen.

37 Claims, 10 Drawing Sheets

U.S. PATENT DOCUMENTS

| | | | | |
|---|---|---|---|---|
| 5,152,529 | A | 10/1992 | Okada | |
| 5,319,491 | A | 6/1994 | Selbrede | |
| 5,342,047 | A | 8/1994 | Heidel et al. | |
| 5,364,100 | A | 11/1994 | Ludlow et al. | |
| 5,375,830 | A | 12/1994 | Takemoto et al. | |
| 5,376,587 | A | 12/1994 | Buchmann et al. | |
| 5,393,057 | A | 2/1995 | Marnell | |
| 5,393,061 | A | 2/1995 | Manship et al. | |
| 5,395,111 | A | 3/1995 | Inoue | |
| 5,467,893 | A | 11/1995 | Landis, II et al. | |
| 5,539,547 | A | 7/1996 | Ishii et al. | |
| 5,580,055 | A | 12/1996 | Hagiwara | |
| 5,585,821 | A | 12/1996 | Ishikura et al. | |
| 5,589,980 | A | 12/1996 | Bass et al. | |
| 5,647,798 | A | 7/1997 | Faiciglia | |
| 5,725,428 | A | 3/1998 | Achmueller | |
| 5,745,197 | A | 4/1998 | Leung et al. | |
| 5,752,881 | A | 5/1998 | Inoue | |
| 5,762,552 | A | 6/1998 | Vuong et al. | |
| 5,764,317 | A | 6/1998 | Sadnovik et al. | |
| 5,785,315 | A | 7/1998 | Eiteneer et al. | |
| 5,788,573 | A | 8/1998 | Baerlocher et al. | |
| 5,833,537 | A | 11/1998 | Barrie | |
| 5,851,148 | A | 12/1998 | Brune et al. | |
| 5,910,046 | A | 6/1999 | Wada et al. | |
| 5,923,307 | A * | 7/1999 | Hogle, IV | 345/4 |
| 5,951,397 | A | 9/1999 | Dickinson | |
| 5,956,180 | A | 9/1999 | Bass et al. | |
| 5,967,893 | A | 10/1999 | Lawrence et al. | |
| 5,988,638 | A | 11/1999 | Rodesch et al. | |
| 5,993,027 | A | 11/1999 | Yamamoto et al. | |
| 6,001,016 | A | 12/1999 | Walker et al. | |
| 6,015,346 | A | 1/2000 | Bennett | |
| 6,027,115 | A | 2/2000 | Griswold et al. | |
| 6,050,895 | A | 4/2000 | Luciano et al. | |
| 6,054,969 | A | 4/2000 | Haisma | |
| 6,057,814 | A | 5/2000 | Kalt | |
| 6,059,289 | A | 5/2000 | Vancura | |
| 6,059,658 | A | 5/2000 | Mangano et al. | |
| 6,068,552 | A | 5/2000 | Walker | |
| 6,086,066 | A | 7/2000 | Takeuchi | |
| 6,093,102 | A | 7/2000 | Bennett | |
| 6,135,884 | A | 10/2000 | Hedrick et al. | |
| 6,159,095 | A | 12/2000 | Frohm et al. | |
| 6,159,098 | A | 12/2000 | Slomiany et al. | |
| 6,168,520 | B1 | 1/2001 | Baerlocher et al. | |
| 6,190,255 | B1 | 2/2001 | Thomas et al. | |
| 6,213,875 | B1 | 4/2001 | Suzuki | |
| 6,227,971 | B1 | 5/2001 | Weiss | |
| 6,234,897 | B1 | 5/2001 | Frohm et al. | |
| 6,244,596 | B1 | 6/2001 | Kondratjuk | |
| 6,251,013 | B1 | 6/2001 | Bennett | |
| 6,251,014 | B1 | 6/2001 | Stockdale et al. | |
| 6,252,707 | B1 | 6/2001 | Kleinberger et al. | |
| 6,254,481 | B1 | 7/2001 | Jaffe | |
| 6,261,178 | B1 | 7/2001 | Bennett | |
| 6,270,411 | B1 | 8/2001 | Gura et al. | |
| 6,297,785 | B1 | 10/2001 | Sommer et al. | |
| 6,315,666 | B1 | 11/2001 | Mastera et al. | |
| 6,322,445 | B1 | 11/2001 | Miller | |
| 6,337,513 | B1 | 1/2002 | Clevenger et al. | |
| 6,347,996 | B1 | 2/2002 | Gilmore et al. | |
| 6,368,216 | B1 | 4/2002 | Hedrick et al. | |
| 6,379,244 | B1 | 4/2002 | Sagawa et al. | |
| 6,398,220 | B1 | 6/2002 | Inoue | |
| 6,416,827 | B1 | 7/2002 | Chakrapani et al. | |
| 6,444,496 | B1 | 9/2002 | Edwards et al. | |
| 6,445,185 | B1 | 9/2002 | Damadian et al. | |
| 6,491,583 | B1 | 12/2002 | Gauselmann | |
| 6,503,147 | B1 | 1/2003 | Stockdale et al. | |
| 6,511,375 | B1 | 1/2003 | Kaminkow | |
| 6,512,559 | B1 | 1/2003 | Hashimoto et al. | |
| 6,514,141 | B1 | 2/2003 | Kaminkow et al. | |
| 6,517,433 | B2 | 2/2003 | Loose et al. | |
| 6,517,437 | B1 | 2/2003 | Wells et al. | |
| 6,520,856 | B1 | 2/2003 | Walker et al. | |
| 6,532,146 | B1 * | 3/2003 | Duquette | 361/679.04 |
| 6,547,664 | B2 | 4/2003 | Saunders | |
| 6,575,541 | B1 | 6/2003 | Hedrick et al. | |
| 6,585,591 | B1 | 7/2003 | Baerlocher et al. | |
| 6,612,927 | B1 | 9/2003 | Slomiany | |
| D480,961 | S | 10/2003 | Deadman | |
| 6,643,124 | B1 * | 11/2003 | Wilk | 361/679.04 |
| 6,644,664 | B2 | 11/2003 | Muir et al. | |
| 6,646,695 | B1 | 11/2003 | Gauselmann | |
| 6,652,378 | B2 | 11/2003 | Cannon et al. | |
| 6,659,864 | B2 | 12/2003 | McGahn et al. | |
| 6,661,425 | B1 | 12/2003 | Hiroaki | |
| 6,695,696 | B1 | 2/2004 | Kaminkow | |
| 6,695,703 | B1 | 2/2004 | McGahn | |
| 6,702,675 | B2 | 3/2004 | Poole et al. | |
| 6,712,694 | B1 | 3/2004 | Nordman | |
| 6,715,756 | B2 | 4/2004 | Inoue | |
| 6,717,728 | B2 | 4/2004 | Putilin | |
| 6,722,979 | B2 | 4/2004 | Gilmore et al. | |
| 6,802,777 | B2 | 10/2004 | Seelig et al. | |
| 6,817,945 | B2 | 11/2004 | Seelig et al. | |
| 6,817,946 | B2 | 11/2004 | Motegi et al. | |
| 6,859,219 | B1 * | 2/2005 | Sall | 345/1.1 |
| 6,887,157 | B2 | 5/2005 | LeMay et al. | |
| 6,890,259 | B2 | 5/2005 | Breckner et al. | |
| 6,906,762 | B1 | 6/2005 | Witehira et al. | |
| 6,908,381 | B2 | 6/2005 | Ellis | |
| 6,937,298 | B2 | 8/2005 | Okada | |
| 6,981,635 | B1 | 1/2006 | Hughs-Baird et al. | |
| 7,040,987 | B2 | 5/2006 | Walker et al. | |
| 7,056,215 | B1 | 6/2006 | Olive | |
| 7,095,180 | B2 | 8/2006 | Emslie et al. | |
| 7,097,560 | B2 | 8/2006 | Okada | |
| 7,108,603 | B2 | 9/2006 | Olive | |
| 7,115,033 | B1 | 10/2006 | Timperley | |
| 7,128,647 | B2 | 10/2006 | Muir | |
| 7,159,865 | B2 | 1/2007 | Okada | |
| 7,160,187 | B2 | 1/2007 | Loose et al. | |
| 7,166,029 | B2 | 1/2007 | Enzminger | |
| 7,204,753 | B2 | 4/2007 | Ozaki et al. | |
| 7,207,883 | B2 | 4/2007 | Nozaki et al. | |
| 7,220,181 | B2 | 5/2007 | Okada | |
| 7,227,510 | B2 * | 6/2007 | Mayer et al. | 345/1.1 |
| 7,237,202 | B2 * | 6/2007 | Gage | 715/761 |
| 7,252,288 | B2 | 8/2007 | Seelig et al. | |
| 7,252,591 | B2 | 8/2007 | Van Asdale | |
| 7,255,643 | B2 | 8/2007 | Ozaki et al. | |
| 7,274,413 | B1 | 9/2007 | Sullivan et al. | |
| 7,285,049 | B1 | 10/2007 | Luciano, Jr. et al. | |
| 7,309,284 | B2 | 12/2007 | Griswold et al. | |
| 7,322,884 | B2 | 1/2008 | Emori et al. | |
| 7,324,094 | B2 | 1/2008 | Moilanen et al. | |
| 7,329,181 | B2 | 2/2008 | Hoshino et al. | |
| 7,352,424 | B2 | 4/2008 | Searle | |
| 7,439,683 | B2 | 10/2008 | Emslie | |
| 7,473,173 | B2 | 1/2009 | Peterson et al. | |
| 7,505,049 | B2 | 3/2009 | Engel | |
| 7,510,475 | B2 | 3/2009 | Loose et al. | |
| 7,558,057 | B1 | 7/2009 | Naksen et al. | |
| 7,559,837 | B1 | 7/2009 | Yoseloff et al. | |
| 7,619,585 | B2 | 11/2009 | Bell et al. | |
| 7,624,339 | B1 | 11/2009 | Engel et al. | |
| 7,626,594 | B1 | 12/2009 | Witehira et al. | |
| 7,724,208 | B1 | 5/2010 | Engel et al. | |
| 7,730,413 | B1 | 6/2010 | Engel | |
| 7,742,124 | B2 | 6/2010 | Bell | |
| 7,742,239 | B2 | 6/2010 | Bell | |
| 7,841,944 | B2 | 11/2010 | Wells | |
| 7,951,001 | B2 | 5/2011 | Wells | |
| 8,012,010 | B2 | 9/2011 | Wilson et al. | |
| 2001/0013681 | A1 | 8/2001 | Bruzzese et al. | |
| 2001/0016513 | A1 | 8/2001 | Muir et al. | |
| 2001/0031658 | A1 | 10/2001 | Ozaki | |
| 2002/0022518 | A1 | 2/2002 | Okuda et al. | |
| 2002/0045472 | A1 | 4/2002 | Adams | |
| 2002/0086725 | A1 | 7/2002 | Fasbender et al. | |
| 2002/0119035 | A1 | 8/2002 | Hamilton | |
| 2002/0142825 | A1 | 10/2002 | Lark et al. | |
| 2002/0167637 | A1 | 11/2002 | Burke | |
| 2002/0173354 | A1 | 11/2002 | Winans et al. | |
| 2002/0175466 | A1 | 11/2002 | Loose et al. | |

2002/0183105 A1 12/2002 Cannon
2002/0183109 A1 12/2002 McGahn et al.
2003/0026171 A1 2/2003 Brewer et al.
2003/0027624 A1 2/2003 Gilmore et al.
2003/0032478 A1 2/2003 Takahama et al.
2003/0032479 A1 2/2003 LeMay et al.
2003/0045345 A1 3/2003 Berman
2003/0060271 A1 3/2003 Gilmore et al.
2003/0064781 A1 4/2003 Muir
2003/0069063 A1 4/2003 Bilyeu et al.
2003/0087690 A1 5/2003 Loose et al.
2003/0128427 A1 7/2003 Kalmanash
2003/0130026 A1 7/2003 Breckner et al.
2003/0130028 A1 7/2003 Aida et al.
2003/0148804 A1 8/2003 Ikeya et al.
2003/0157980 A1 8/2003 Loose et al.
2003/0176214 A1 9/2003 Burak et al.
2003/0199295 A1 10/2003 Vancura
2003/0220134 A1 11/2003 Walker et al.
2003/0234489 A1 12/2003 Okada
2003/0236114 A1 12/2003 Griswold et al.
2003/0236118 A1 12/2003 Okada
2004/0009803 A1 1/2004 Bennett et al.
2004/0023714 A1 2/2004 Asdale
2004/0029636 A1* 2/2004 Wells ..... 463/32
2004/0036218 A1 2/2004 Inoue
2004/0063490 A1 4/2004 Okada
2004/0066475 A1 4/2004 Searle
2004/0077401 A1 4/2004 Schlottmann et al.
2004/0102244 A1 5/2004 Kryuchkov et al.
2004/0102245 A1 5/2004 Escalera et al.
2004/0116178 A1 6/2004 Okada
2004/0142748 A1 7/2004 Loose et al.
2004/0147303 A1 7/2004 Imura et al.
2004/0150162 A1 8/2004 Okada
2004/0162146 A1 8/2004 Ooto
2004/0166925 A1 8/2004 Emori et al.
2004/0166927 A1 8/2004 Okada
2004/0171423 A1 9/2004 Silva et al.
2004/0183251 A1 9/2004 Inoue
2004/0183972 A1 9/2004 Bell
2004/0192430 A1 9/2004 Burak et al.
2004/0198485 A1 10/2004 Loose
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada
2004/0209672 A1 10/2004 Okada
2004/0209678 A1 10/2004 Okada
2004/0209683 A1 10/2004 Okada
2004/0214635 A1 10/2004 Okada
2004/0214637 A1 10/2004 Nonaka
2004/0219967 A1 11/2004 Giobbi et al.
2004/0224747 A1 11/2004 Okada
2004/0227721 A1 11/2004 Moilanen et al.
2004/0233663 A1 11/2004 Emslie et al.
2004/0235558 A1 11/2004 Beaulieu et al.
2004/0239582 A1 12/2004 Seymour
2004/0266515 A1 12/2004 Gauselmann
2004/0266536 A1 12/2004 Mattice et al.
2005/0020348 A1 1/2005 Thomas et al.
2005/0026673 A1 2/2005 Paulsen et al.
2005/0032571 A1 2/2005 Asonuma
2005/0037843 A1 2/2005 Wells et al.
2005/0049032 A1 3/2005 Kobayashi
2005/0049046 A1 3/2005 Kobayashi
2005/0052341 A1 3/2005 Henriksson
2005/0062410 A1 3/2005 Bell
2005/0063055 A1 3/2005 Engel
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0164786 A1 7/2005 Connelly
2005/0176493 A1 8/2005 Nozaki et al.
2005/0192090 A1 9/2005 Muir et al.
2005/0206582 A1 9/2005 Bell et al.
2005/0208994 A1 9/2005 Berman
2005/0233799 A1 10/2005 LeMay et al.
2005/0239539 A1 10/2005 Inamura
2005/0253775 A1* 11/2005 Stewart ..... 345/1.1
2005/0255908 A1 11/2005 Wells et al.
2005/0266912 A1 12/2005 Sekiguchi
2005/0285337 A1 12/2005 Durham et al.
2006/0025199 A1 2/2006 Harkins et al.
2006/0058100 A1 3/2006 Pacey et al.
2006/0063580 A1 3/2006 Nguyen et al.
2006/0073881 A1 4/2006 Pryzby
2006/0100014 A1 5/2006 Griswold et al.
2006/0103951 A1 5/2006 Bell et al.
2006/0111179 A1 5/2006 Inamura
2006/0125745 A1 6/2006 Evanicky
2006/0166727 A1 7/2006 Burak
2006/0191177 A1 8/2006 Engel
2006/0256033 A1* 11/2006 Chan et al. ..... 345/1.1
2006/0284574 A1 12/2006 Emslie et al.
2006/0290594 A1 12/2006 Engel et al.
2007/0004510 A1 1/2007 Underdahl et al.
2007/0004513 A1 1/2007 Wells et al.
2007/0010315 A1 1/2007 Hein
2007/0057866 A1* 3/2007 Lee et al. ..... 345/1.1
2007/0072665 A1 3/2007 Muir
2007/0077986 A1 4/2007 Loose
2007/0091011 A1 4/2007 Selbrede
2007/0105610 A1 5/2007 Anderson
2007/0105611 A1 5/2007 O'Halloran
2007/0105628 A1 5/2007 Arbogast et al.
2007/0252804 A1 11/2007 Engel
2008/0004104 A1 1/2008 Durham et al.
2008/0007486 A1 1/2008 Fujinawa et al.
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0064497 A1 3/2008 Griswold et al.
2008/0068290 A1* 3/2008 Muklashy et al. ..... 345/2.1
2008/0096655 A1 4/2008 Rasmussen et al.
2008/0108422 A1 5/2008 Hedrick et al.
2008/0113716 A1 5/2008 Beadell et al.
2008/0113745 A1 5/2008 Williams et al.
2008/0113746 A1 5/2008 Williams et al.
2008/0113747 A1 5/2008 Williams et al.
2008/0113748 A1 5/2008 Williams et al.
2008/0113749 A1 5/2008 Williams et al.
2008/0113756 A1 5/2008 Williams et al.
2008/0113775 A1 5/2008 Williams et al.
2008/0125219 A1 5/2008 Williams et al.
2008/0136741 A1 6/2008 Williams et al.
2008/0261674 A9 10/2008 Okada
2008/0284792 A1 11/2008 Bell
2009/0036208 A1 2/2009 Wells et al.
2009/0061983 A1 3/2009 Kaufman et al.
2009/0061984 A1 3/2009 Yi et al.
2009/0069069 A1 3/2009 Crowder, Jr. et al.
2009/0069070 A1 3/2009 Crowder, Jr. et al.
2009/0079667 A1 3/2009 Schlottmann et al.
2009/0082083 A1 3/2009 Wilson et al.
2009/0091513 A1 4/2009 Kuhn
2009/0104989 A1 4/2009 Williams et al.
2009/0258697 A1 10/2009 Kelly et al.
2009/0258701 A1 10/2009 Crowder, Jr. et al.
2009/0280888 A1 11/2009 Durham et al.
2009/0312095 A1 12/2009 Durham et al.
2010/0045601 A1 2/2010 Engel et al.
2010/0115391 A1 5/2010 Engel et al.
2010/0115439 A1 5/2010 Engel
2010/0190545 A1 7/2010 Lauzon et al.
2010/0214195 A1 8/2010 Ogasawara et al.
2010/0234089 A1 9/2010 Saffari et al.
2011/0065490 A1 3/2011 Lutnick et al.
2011/0294562 A1 12/2011 Wilson et al.

FOREIGN PATENT DOCUMENTS

AU 2000PQ9586 8/2000
CA 2265283 9/1999
EP 0 454 423 10/1991
EP 0 484 103 5/1992

| | | | |
|---|---|---|---|
| EP | 0 860 807 | | 8/1998 |
| EP | 0 919 965 | | 6/1999 |
| EP | 0 997 857 | | 10/1999 |
| EP | 1 000 642 | | 5/2000 |
| EP | 1 260 928 | | 11/2002 |
| EP | 1 282 088 | | 2/2003 |
| EP | 1 369 830 AI | | 12/2003 |
| EP | 1 391 847 | | 2/2004 |
| EP | 1 462 152 | A2 | 9/2004 |
| EP | 1 492 063 | | 7/2005 |
| EP | 1 826 739 | | 8/2007 |
| GB | 1 464 896 | | 2/1977 |
| GB | 2 120 506 | | 11/1983 |
| GB | 2 253 300 | | 9/1992 |
| GB | 2 316 214 | | 2/1998 |
| GB | 2 385 004 | A | 8/2003 |
| JP | H02-90884 | | 7/1990 |
| JP | H03-20388 | | 2/1991 |
| JP | 04-220276 | | 8/1992 |
| JP | H05-68585 | | 9/1993 |
| JP | 06-043425 | | 2/1994 |
| JP | 07-124290 | | 5/1995 |
| JP | H10-015247 | | 1/1998 |
| JP | 10-234932 | A | 9/1998 |
| JP | 11-000441 | A | 1/1999 |
| JP | H11-137852 | | 5/1999 |
| JP | 2000-300729 | | 10/2000 |
| JP | 00-350805 | | 12/2000 |
| JP | 2000-354685 | | 12/2000 |
| JP | 01-062032 | | 3/2001 |
| JP | 01-238995 | | 9/2001 |
| JP | 01-252393 | | 9/2001 |
| JP | 01-252394 | | 9/2001 |
| JP | 02-085624 | | 3/2002 |
| JP | 2004-089707 | | 3/2004 |
| JP | 2004-105616 | | 4/2004 |
| JP | 04-166879 | | 6/2004 |
| JP | 2005-253561 | | 9/2005 |
| JP | 2005-266387 | | 9/2005 |
| JP | 2005-266388 | | 9/2005 |
| JP | 2005-274906 | | 10/2005 |
| JP | 2005-274907 | | 10/2005 |
| JP | 2005-283864 | | 10/2005 |
| JP | 2006-059607 | | 3/2006 |
| JP | 2006-346226 | | 12/2006 |
| JP | 2007-200869 | | 8/2007 |
| RU | 2 053 559 | C1 | 1/1996 |
| RU | 2145116 | C1 | 1/2000 |
| RU | 29794 | U1 | 5/2003 |
| WO | WO 93/13446 | | 7/1993 |
| WO | 99/42889 | | 8/1999 |
| WO | 99/44095 | | 9/1999 |
| WO | WO 99/53454 | | 10/1999 |
| WO | WO 00/32286 | | 6/2000 |
| WO | 01/15127 | | 3/2001 |
| WO | 01/15128 | | 3/2001 |
| WO | 01/15132 | | 3/2001 |
| WO | WO 01/38926 | | 5/2001 |
| WO | 01/09664 | | 8/2001 |
| WO | WO 02/41046 | | 5/2002 |
| WO | WO 02/084637 | | 10/2002 |
| WO | WO 02/086610 | | 10/2002 |
| WO | WO 02/089102 | | 11/2002 |
| WO | WO 03/001486 | | 1/2003 |
| WO | WO 03/023491 | | 3/2003 |
| WO | WO 03/032058 | | 4/2003 |
| WO | 03/039699 | | 5/2003 |
| WO | WO 03/040820 | | 5/2003 |
| WO | PCT/NZ2003/00153 | | 7/2003 |
| WO | WO 03/079094 | | 9/2003 |
| WO | 2004/001486 | | 12/2003 |
| WO | WO 04/001488 | | 12/2003 |
| WO | WO 04/002143 | | 12/2003 |
| WO | WO 2004/008226 | | 1/2004 |
| WO | WO 2004/023825 | | 3/2004 |
| WO | WO 2004/025583 | | 3/2004 |
| WO | WO 2004/036286 | | 4/2004 |
| WO | WO 2004/060512 | | 7/2004 |
| WO | WO 2004/079674 | | 9/2004 |
| WO | 2004/102520 | | 11/2004 |
| WO | WO 2005/071629 | A1 | 8/2005 |
| WO | 2006/034192 | | 3/2006 |
| WO | 2006/038819 | | 4/2006 |
| WO | WO 2006/112740 | | 10/2006 |
| WO | WO 2007/040413 | | 4/2007 |
| WO | WO 2008/005278 | | 1/2008 |
| WO | WO 2008/028153 | | 3/2008 |
| WO | WO 2008/048857 | | 4/2008 |
| WO | WO 2008/061068 | | 5/2008 |
| WO | WO 2008/062914 | | 5/2008 |
| WO | WO 2008/063908 | | 5/2008 |
| WO | WO 2008/063914 | | 5/2008 |
| WO | WO 2008/063952 | | 5/2008 |
| WO | WO 2008/063956 | | 5/2008 |
| WO | WO 2008/063968 | | 5/2008 |
| WO | WO 2008/063969 | | 5/2008 |
| WO | WO 2008/063971 | | 5/2008 |
| WO | WO 2008/079542 | | 7/2008 |
| WO | WO 2009/029720 | | 3/2009 |
| WO | WO 2009/039245 | | 3/2009 |
| WO | WO 2009/039295 | | 3/2009 |
| WO | WO 2009/054861 | | 4/2009 |
| WO | WO 2010/023537 | | 3/2010 |
| WO | WO 2010/039411 | | 4/2010 |

OTHER PUBLICATIONS

"Debut of the Let's Make a Deal Slot Machine," Let's Make a Deal 1999-2002, http:///www.letsmakeadeal.com/pr01.htm. Printed Dec. 3, 2002 (2 pages).
"Light Valve". [online] [retrieved on Nov. 15, 2005]. Retrieved from the Internet URL http://www.meko.co.uk/lightvalve.shtml (1 page).
"Liquid Crystal Display". [online]. [retrieved on Nov. 16, 2005]. Retrieved form the Internet URL http://en.wikipedia.org/wiki/LCD (6 pages).
"SPD," Malvino Inc., www.malvino corn, Jul. 19, 1999 (10 pages).
"What is SPD?" SPD Systems, Inc. 2002, http://www.spd-systems.com/spdq.htm. Printed Dec. 4, 2002 (2 pages).
Bonsor, Kevin, "How Smart Windows Will Work," Howstuffworks, Inc. 1998-2002, http://www/howstuffworks.com/smart-window.htm/printable. Printed Nov. 25, 2002 (5 pages).
Bosner, "How Smart Windows Work," HowStuffWorks, Inc.,www.howstuffworks.com, 1998-2004 (9 pages).
International Exam Report dated Sep. 21, 2007 in European Application No. 05 705 315.9.
International Search Report dated Jun. 2, 2005 from International Application No. PCT/US2005/000950 (5 page document).
Living in a flat world? Advertisement written by Deep Video Imaging Ltd., published 2000 (21 pages).
Novel 3-D Video Display Technology Developed, News release: Aug. 30, 1996, www.eurekalert.org/summaries/1199.htm1, printed from Internet Archive using date Sep. 2, 2000 (1 page).
Saxe et al., "Suspended-Particle Devices," www.refr-spd.com, Apr./May 1996 (5 pages).
Time Multiplexed Optical Shutter (TMOS): A revolutionary Flat Screen Display Technology, www.vea.com/TMOS.html, Apr. 8, 1999, printed from Internet Archive using date Oct. 6, 1999 (6 pages).
Time Multiplexed Optical Shutter (TMOS): A revolutionary Flat Screen Display Technology, www.tralas.com/TMOS.html, Apr. 5, 2001, printed from Internet Archive using date Apr. 11, 2001 (6 pages).
U.S. Appl. No. 11/849,119, filed Aug. 31, 2007.
U.S. Appl. No. 11/858,695, filed Sep. 20, 2007.
U.S. Appl. No. 11/858,845, filed Sep. 20, 2007.
U.S. Appl. No. 11/858,849, filed Sep. 20, 2007.
U.S. Appl. No. 11/859,127, filed Sep. 21, 2007.
U.S. Appl. No. 11/938,184, filed Nov. 9, 2007.
Written Opinion of the International Searching Authority dated May 25, 2005, for PCT Application No. PCT/US2005/000597 (7 pages).
Written Opinion of the International Searching Authority dated Jun. 2, 2005 from International Patent Application No. PCT/US2005/000950 (7 pages).
U.S. Appl. No. 11/938,086, filed Nov. 9, 2007.
U.S. Appl. No. 11/938,151, filed Nov. 9, 2007.

Office Action dated Aug. 29, 2007 from U.S. Appl. No. 10/755,598.
Office Action dated Oct. 31, 2007 from U.S. Appl. No. 10/213,626.
Final Office Action dated Mar. 28, 2007 from U.S. Appl. No. 10/213,626.
Office Action dated Apr. 27, 2006 from U.S. Appl. No. 10/213,626.
Final Office Action dated Jan. 10, 2006 from U.S. Appl. No. 10/213,626.
Office Action dated Aug. 31, 2004 from U.S. Appl. No. 10/213,626.
U.S. Appl. No. 11/877,611, filed Oct. 23, 2007.
European Office Action dated Sep. 13, 2007 in Application No. 05 705 315.9.
International Search Report and Written Opinion, mailed on May 20, 2008 for PCT/US2007/084458.
International Search Report and Written Opinion, mailed on May 20, 2008 for PCT/US2007/084421.
Final Office Action mailed Apr. 23, 2008 for U.S. Appl. No. 10/755,598.
U.S. Appl. No. 12/849,284, filed Aug. 3, 2010, Silva, Gregory A.
U.S. Appl. No. 09/622,409, filed Nov. 6, 2000, Engel, Gabriel.
U.S. Office Action dated Mar. 30, 2010 issued in U.S. Appl. No. 11/938,086 [P190C1].
U.S. Office Action Final dated Aug. 19, 2010 issued in U.S. Appl. No. 11/938,086 [P190C1].
U.S. Office Action dated Dec. 3, 2010 issued in U.S. Appl. No. 11/938,086 [P190C1].
U.S. Examiner Interview Summary dated Mar. 9, 2011 issued in U.S. Appl. No. 11/938,086 [P190C1].
U.S. Notice of Allowance dated Apr. 18, 2011 issued in U.S. Appl. No. 11/938,086 [P190C1].
U.S. Office Action dated Oct. 9, 2009 issued in U.S. Appl. No. 11/514,808 [P194].
U.S. Office Action Final dated Apr. 22, 2010 issued in U.S. Appl. No. 11/514,808 [P194].
U.S. Office Action dated Oct. 18, 2010 issued in U.S. Appl. No. 11/514,808 [P194].
U.S. Office Action Final dated Apr. 27, 2011 issued in U.S. Appl. No. 11/514,808 [P194].
U.S. Office Action dated Dec. 2, 2009 issued in U.S. Appl. No. 11/829,852 [P194C1].
U.S. Office Action dated Jul. 14, 2010 issued in U.S. Appl. No. 11/829,852 [P194C1].
U.S. Office Action dated Nov. 14, 2008 issued in U.S. Appl. No. 11/829,853 [P194C2].
U.S. Office Action dated Oct. 31, 2008 issued in U.S. Appl. No. 11/829,849 [P194C3].
U.S. Office Action dated Oct. 8, 2008 issued in U.S. Appl. No. 10/755,598 [P197].
U.S. Office Action Final dated Jul. 1, 2009 issued in U.S. Appl. No. 10/755,598 [P197].
U.S. Office Action Final dated Jan. 22, 2010 issued in U.S. Appl. No. 10/755,598 [P197].
U.S. Office Action Final dated Aug. 4, 2010 issued in U.S. Appl. No. 10/755,598 [P197].
U.S. Notice of Panel Decision from Pre-Appeal Brief Review dated Dec. 1, 2010 issued in U.S. Appl. No. 10/755,598 [P197].
U.S. Office Action dated Mar. 28, 2011 issued in U.S. Appl. No. 10/755,598 [P197].
U.S. Office Action dated Oct. 31, 2008 issued in U.S. Appl. No. 11/829,917 [P197C1].
U.S. Office Action Final dated Aug. 11, 2009 issued in U.S. Appl. No. 11/829,917 [P197C1].
U.S. Office Action dated Jan. 29, 2010 issued in U.S. Appl. No. 11/829,917 [P197C1].
U.S. Office Action Final dated Aug. 5, 2010 issued in U.S. Appl. No. 11/829,917 [P197C1].
U.S. Office Action dated Jun. 23, 2009 issued in U.S. Appl. No. 11/938,151 [P397].
U.S. Office Action Final dated Feb. 8, 2010 issued in U.S. Appl. No. 11/938,151 [P397].
U.S. Advisory Action dated Apr. 22, 2010 issued in U.S. Appl. No. 11/938,151 [P397].
U.S. Office Action dated Jul. 23, 2010 issued in U.S. Appl. No. 11/938,151 [P397].
U.S. Office Action Final dated Jan. 4, 2011 issued in U.S. Appl. No. 11/938,151 [P397].
U.S. Office Action (Notice of Panel Decision from Pre-Appeal Brief Review) dated Apr. 27, 2011 issued in U.S. Appl. No. 11/938,151 [P397].
U.S. Office Action dated Jul. 9, 2010 issued in U.S. Appl. No. 11/858,849 [P413].
U.S. Office Action Final dated Nov. 30, 2010 issued in U.S. Appl. No. 11/858,849 [P413].
U.S. Office Action dated Mar. 22, 2011 issued in U.S. Appl. No. 11/858,849 [P413].
U.S. Office Action dated Jul. 9, 2009 issued in U.S. Appl. No. 11/858,700 [P436].
U.S. Office Action Final dated Jan. 4, 2010 issued in U.S. Appl. No. 11/858,700 [P436].
U.S. Office Action Final dated Apr. 7, 2010 issued in U.S. Appl. No. 11/858,700 [P436].
U.S. Office Action dated Aug. 5, 2010 issued in U.S. Appl. No. 11/858,700 [P436].
U.S. Office Action Final dated Dec. 27, 2010 issued in U.S. Appl. No. 11/858,700 [P436].
U.S. Office Action dated Jul. 9, 2009 issued in U.S. Appl. No. 11/858,695 [P437].
U.S. Office Action Final dated Jan. 4, 2010 issued in U.S. Appl. No. 11/858,695 [P437].
U.S. Office Action Final dated Mar. 29, 2010 issued in U.S. Appl. No. 11/858,695 [P437].
U.S. Office Action Final dated Jul. 7, 2010 issued in U.S. Appl. No. 11/858,695 [P437].
U.S. Office Action dated Apr. 28, 2011 issued in U.S. Appl. No. 11/858,793 [P438].
U.S. Office Action dated Jul. 9, 2009 issued in U.S. Appl. No. 11/858,693 [P440].
U.S. Office Action Final dated Mar. 23, 2010 issued in U.S. Appl. No. 11/858,693 [P440].
U.S. Advisory Action dated Jun. 1, 2010 issued in U.S. Appl. No. 11/858,693 [P440].
U.S. Office Action dated Aug. 5, 2010 issued in U.S. Appl. No. 11/858,693 [P440].
U.S. Office Action Final dated Feb. 7, 2011 issued in U.S. Appl. No. 11/858,693 [P440].
U.S. Interview Summary dated Mar. 29, 2011 issued in U.S. Appl. No. 11/858,693 [P440].
U.S. Advisory Action dated Apr. 8, 2011 issued in U.S. Appl. No. 11/858,693 [P440].
U.S. Office Action dated Jul. 10, 2009 issued in U.S. Appl. No. 11/858,845 [P441].
U.S. Office Action Final dated Feb. 5, 2010 issued in U.S. Appl. No. 11/858,845 [P441].
U.S. Notice of Panel Decision from Pre-Appeal Brief Review dated Jun. 8, 2010 issued in U.S. Appl. No. 11/858,845 [P441].
U.S. Office Action dated Apr. 7, 2011 issued in U.S. Appl. No. 11/849,119 [P442].
U.S. Office Action dated Nov. 12, 2010 issued in U.S. Appl. No. 11/859,127 [P443].
U.S. Notice of Allowance dated May 4, 2011 issued in U.S. Appl. No. 11/859,127 [P443].
U.S. Office Action dated Jan. 20, 2011 issued in U.S. Appl. No. 11/983,770 [P334X6].
U.S. Office Action dated Jun. 13, 2003 issued in U.S. Appl. No. 09/966,851 [P463].
U.S. Office Action dated Mar. 30, 2004 issued in U.S. Appl. No. 09/966,851 [P463].
U.S. Office Action Final dated Dec. 14, 2004 issued in U.S. Appl. No. 09/966,851 [P463].
U.S. Notice of Allowance dated Jun. 13, 2006 issued in U.S. Appl. No. 09/966,851 [P463].
U.S. Office Action dated Sep. 9, 2009 issued in U.S. Appl. No. 11/549,258 [P463X1].
U.S. Office Action Final dated Mar. 26, 2010 issued in U.S. Appl. No. 11/549,258 [P463X1].
U.S. Office Action dated Jul. 9, 2010 issued in U.S. Appl. No. 11/549,258 [P463X1].

U.S. Office Action Final dated Dec. 21, 2010 issued in U.S. Appl. No. 11/549,258 [P463X1].
U.S. Office Action dated Jun. 23, 2009 issued in U.S. Appl. No. 11/938,184 [P465].
U.S. Office Action Final dated Feb. 8, 2010 issued in U.S. Appl. No. 11/938,184 [P465].
U.S. Office Action dated Aug. 5, 2010 issued in U.S. Appl. No. 11/938,184 [P465].
U.S. Examiner Interview Summary dated Nov. 4, 2010 issued in U.S. Appl. No. 11/938,184 [P465].
U.S. Office Action Final dated Jan. 20, 2011 issued in U.S. Appl. No. 11/938,184 [P465].
U.S. Advisory Action dated Mar. 25, 2011 issued in U.S. Appl. No. 11/938,184 [P465].
U.S. Office Action dated Nov. 17, 2004 issued in U.S. Appl. No. 10/376,852 [P544].
U.S. Office Action dated Apr. 13, 2005 issued in U.S. Appl. No. 10/376,852 [P544].
U.S. Office Action Final dated Nov. 18, 2005 issued in U.S. Appl. No. 10/376,852 [P544].
U.S. Advisory Action dated Feb. 7, 2006 issued in U.S. Appl. No. 10/376,852 [P544].
U.S. Office Action dated Sep. 19, 2006 issued in U.S. Appl. No. 10/376,852 [P544].
U.S. Notice of Informal or Non-Responsive Amendment dated Mar. 9, 2007 issued in U.S. Appl. No. 10/376,852 [P544].
U.S. Office Action Final dated Jun. 22, 2007 issued in U.S. Appl. No. 10/376,852 [P544].
U.S. Office Action dated Jan. 28, 2008 issued in U.S. Appl. No. 10/376,852 [P544].
U.S. Office Action Final dated Aug. 6, 2008 issued in U.S. Appl. No. 10/376,852 [P544].
U.S. Office Action dated Feb. 2, 2009 issued in U.S. Appl. No. 10/376,852 [P544].
U.S. Notice of Allowance dated Nov. 10 , 2009 issued in U.S. Appl. No. 10/376,852 [P544].
U.S. Office Action dated Mar. 25, 2010 issued in U.S. Appl. No. 10/376,852 [P544].
U.S. Examiner Interview Summary dated Oct. 28, 2004 issued in U.S. Appl. No. 10/213,626 [P604].
U.S. Advisory Action dated Apr. 5, 2006 issued in U.S. Appl. No. 10/213,626 [P604].
U.S. Interview Summary dated Jul. 17, 2007 issued in U.S. Appl. No. 10/213,626 [P604].
U.S. Office Action Final dated Aug. 29, 2008 issued in U.S. Appl. No. 10/213,626 [P604].
U.S. Examiner Interview Summary dated Feb. 26, 2009 issued in U.S. Appl. No. 10/213,626 [P604].
U.S. Examiner Interview Summary dated Mar. 13, 2009 issued in U.S. Appl. No. 10/213,626 [P604].
U.S. Office Action dated Jul. 9, 2009 issued in U.S. Appl. No. 10/213,626 [P604].
U.S. Examiner Interview Summary dated Feb. 4, 2010 issued in U.S. Appl. No. 10/213,626 [P604].
U.S. Notice of Allowance and Examiner Interview Summary dated Mar. 1, 2010 issued in U.S. Appl. No. 10/213,626 [P604].
U.S. Notice of Allowance dated Oct. 4, 2010 issued in U.S. Appl. No. 10/213,626 [P604].
U.S. Office Action dated May 24, 2007 issued in U.S. Appl. No. 11/167,655 [P604C1].
U.S. Examiner Interview Summary dated Jul. 17, 2007 issued in U.S. Appl. No. 11/167,655 [P604C1].
U.S. Office Action dated Jan. 3, 2008 issued in U.S. Appl. No. 11/167,655 [P604C1].
U.S. Office Action Final dated Mar. 8, 2008 issued in U.S. Appl. No. 11/167,655 [P604C1].
U.S. Office Action Final dated Sep. 2, 2008 issued in U.S. Appl. No. 11/167,655 [P604C1].
U.S. Examiner Interview Summary dated Mar. 13, 2009 issued in U.S. Appl. No. 11/167,655 [P604C1].
U.S. Office Action dated Jul. 17, 2009 issued in U.S. Appl. No. 11/167,655 [P604C1].
U.S. Notice of Allowance dated Mar. 11, 2010 issued in U.S. Appl. No. 11/167,655 [P604C1].
U.S. Notice of Allowance dated Jul. 7, 2010 issued in U.S. Appl. No. 11/167,655 [P604C1].
U.S. Notice of Allowance dated Dec. 10, 2010 issued in U.S. Appl. No. 11/167,655 [P604C1].
U.S. Notice of Allowance dated Apr. 1, 2011 issued in U.S. Appl. No. 11/167,655 [P604C1].
PCT International Search Report dated Apr. 9, 2008 issued in WO 2008/028153 [P194WO].
PCT Written Opinion dated Apr. 9, 2008 issued in WO 2008/028153 [P194WO].
PCT International Preliminary Report on Patentability and Written Opinion dated Mar. 3, 2009 issued in WO 2008/028153 [P194WO].
European Examination Report dated Oct. 5, 2009 issued in EP 07 814 629.7 [P194EP].
PCT International Search Report dated Dec. 7, 2009 issued in WO 2010/039411 [P194X1WO].
PCT International Search Report dated May 25, 2005 issued in WO 2005/071629 [P197WO].
PCT International Preliminary Report on Patentability and Written Opinion dated Jul. 17, 2006 issued in WO 2005/071629 [P197WO].
Australian Examiner's First Report dated Nov. 12, 2009 issued in AU2005207309 (P197AU).
Australian Examiner's Report No. 2 dated Sep. 15, 2010 issued in AU Application No. 2005207309 (P197AU).
Chinese First Office Action dated Nov. 28, 2008 issued in CN2005800022940 (P197CN).
Chinese Second Office Action dated Sep. 25, 2009 issued in CN2005800022940 (P197CN).
Chinese Third Office Action dated May 11, 2010 issued in CN2005800022940 (P197CN).
Mexican Office Action (as described by foreign attorney) dated Jun. 18, 2009 issued for MX 06/07950.
Russian Examination and Resolution on Granting Patent dated Jul. 18, 2008 issued in RU 2006-128289-09 (P197RU).
PCT International Search Report dated May 2, 2008 issued in WO 2008/061068 [P334X6WO].
PCT Written Opinion dated May 2, 2008 issued in WO 2008/061068 [P334X6WO].
PCT International Preliminary Report on Patentability and Written Opinion dated May 12, 2009 issued in WO 2008/061068 [P334X6WO].
EP Examination Report dated Oct. 28, 2009 issued in EP 07 845 059.0 1238 [P334X6EP].
PCT International Preliminary Report on Patentability and Written Opinion dated May 19, 2009 issued in WO 2008/063952 [P397WO].
European Examination Report dated Oct. 28, 2009 issued in EP 07 864 281.6 [P397EP].
PCT International Search Report dated Dec. 18, 2008 issued in WO 2009/039245 [P413WO].
PCT Written Opinion dated Dec. 18, 2008 issued in WO 2009/039245 [P413WO].
PCT International Preliminary Report on Patentability and Written Opinion dated Mar. 24, 2010 issued in WO 2009/039245 [P413WO].
PCT International Search Report dated May 7, 2008 issued in WO 2008/063914 [P436WO].
PCT Written Opinion dated May 7, 2008 issued in WO 2008/063914 [P436WO].
PCT International Preliminary Examination Report on Patentability and Written Opinion dated May 19, 2009 issued in WO 2008/063914 [P436WO].
European Examination Report dated Oct. 28, 2009 issued in EP 07 844 998.0 [P436EP].
PCT International Search Report dated May 14, 2008 issued in WO 2008/063956 [P437WO].
PCT Written Opinion dated May 14, 2008 issued in WO 2008/063956 [P437WO].
PCT International Preliminary Report on Patentability and Written Opinion dated May 19, 2009 issued in WO 2008/063956 [P437WO].
PCT International Search Report dated May 8, 2008 issued in issued in WO 2008/063908 [P438WO].

PCT Written Opinion dated May 8, 2008 issued in issued in WO 2008/063908 [P438WO].
PCT International Preliminary Report on Patentability and Written Opinion dated May 19, 2009 issued in WO 2008/063908 [P438WO].
PCT International Search Report dated Jun. 11, 2008 issued in WO 2008/079542 [P440WO].
PCT Written Opinion dated Jun. 11, 2008 issued in WO 2008/079542 [P440WO].
PCT International Preliminary Report on Patentability and Written Opinion dated May 19, 2009 issued in WO 2008/079542 [P440WO].
European Examination Report dated Oct. 28, 2009 issued in EP 07 872 343.4 [P440EP].
PCT International Search Report dated May 20, 2008 issued in WO 2008/063971 [P441WO].
PCT Written Opinion dated May 20, 2008 issued in WO 2008/063971 [P441WO].
PCT International Preliminary Report on Patentability and Written Opinion dated May 19, 2009 issued in WO 2008/063971 [P441WO].
European Examination Report dated Oct. 28, 2009 issued in EP 07 845 062.4 [P441EP].
PCT International Search Report dated Dec. 11, 2008 issued in WO 2009/039295 [P443WO].
PCT Written Opinion dated Dec. 11, 2008 issued in WO 2009/039295 [P443WO].
PCT International Preliminary Report on Patentability and Written Opinion dated Mar. 24, 2010 issued in WO 2009/039295 [P443WO].
PCT International Search Report dated Jul. 16, 2008 issued in WO2009/054861 [P462WO].
PCT Written Opinion dated Jul. 16, 2008 issued in WO2009/054861 [P462WO].
PCT International Preliminary Report on Patentability and Written Opinion dated Apr. 27, 2010 issued in WO 2009/054861 [P462WO].
Australian Examiner's First Report dated Sep. 22, 2005 issued in AU 29246/02.
Australian Notice of Opposition by Aristocrat Technologies dated Apr. 28, 2009 issued in AU 2007200982.
Australian Statement of Grounds and Particulars in Support of Opposition by Aristocrat Technologies dated Jul. 6, 2009 issued in AU 2007200982.
Australian Withdrawal of Opposition by Aristocrat Technologies dated Aug. 12, 2009 issued in AU 2007200982.
PCT International Search Report and Written Opinion dated May 9, 2008 issued in for WO 2008/048857 [P463X1WO].
PCT Written Opinion dated May 9, 2008 issued in WO 2008/048857 [P463X1WO].
PCT International Preliminary Report on Patentability and Written Opinion dated Apr. 15, 2009 issued in WO2008/048857 [P463X1WO].
European Examination Report dated Sep. 10, 2009 issued in EP 07 853 965.7 [P463X1EP].
PCT International Preliminary Report on Patentability and Written Opinion dated May 19, 2009 issued in WO 2008/063969 [P464WO].
PCT International Search Report dated Jul. 21, 2008 issued in WO 2008/063968 [P465WO].
PCT Written Opinion dated Jul. 21, 2008 issued in WO 2008/063968 [P465WO].
PCT International Preliminary Report on Patentability and Written Opinion dated May 19, 2009 issued in WO 2008/063968 [P465WO].
European Examination Report dated Oct. 28, 2009 issued in EP 07 854 617.3 [P465EP].
PCT International Search Report dated Jun. 15, 2004 issued in WO 2004/07974.
PCT International Preliminary Report on Patentability and Written Opinion dated Sep. 2, 2005 issued in WO 2004/07974.
Australian Examiner's First Report dated May 17, 2007 issued in AU 2004216952 (P544AU).
Australian Examiner's Report No. 2 dated Jul. 30, 2007 issued in AU 2004216952 (P544AU).
Australian Examiner's Report No. 3 dated May 28, 2008 issued in AU 2004216952 (P544AU).
Japanese Description of Office Action dated Jul. 4, 2006 issued in Application No. 2005-518567.
Japanese Description of Office Action Final dated Apr. 10, 2007 issued in Application No. 2005-518567.
Japanese Description of Office Action (interrogation) dated May 25, 2009 issued by an Appeal Board in Application No. 2005-518567.
Australian Examiner's First Report dated Apr. 5, 2005 issued in AU2003227286 [P604AU].
Australian Examination Report (as described by Applicant's Attorney) dated Feb. 26, 2009 issued in AU2003227286 [P604AU].
Australian Re-Examination Report dated May 1, 2009 issued in AU2003227286 [P604AU].
Australian Examiner Communication regarding Claims dated Nov. 24, 2009 issued in AU2003227286 [P604AU].
Australian Notice of Acceptance with Exam Comments dated Jan. 28, 2010 issued in AU2003227286 [P604AU].
Australian Examiner's First Report dated Jul. 23, 2007 issued in AU2006203570 [P604AUD1].
Australian Notice of Acceptance with Examiner's Comments dated Nov. 15, 2007 issued in AU2006202570 [P604AUD1].
Australian Re-Examination Report (No. 1) dated Dec. 2, 2009 issued in AU2006203570 [P604AUD1].
Australian Examiner Communication dated Feb. 5, 2010 issued in AU 2006203570 [P604AUD1].
Australian Re-Examination Report (No. 2) dated Feb. 8, 2010 issued in AU 2006203570 [P604AUD1].
Newton, Harry, Newton's Telecom Dictionary, Jan. 1998, Telecom Books and Flatiron Publishing, p. 399.
Police 911, Wikipedia, Jan. 22, 2002, retrieved from Internet at http://en.wilkipedia.org/widi/Police_911 on Oct. 28, 2007, 2 pgs.
U.S. Final Office Action dated May 16, 2011, U.S. Appl. No. 11/983,770.
U.S. Appl. No. 13/027,260, dated Aug. 10, 2011, Wilson.
U.S. Notice of Allowance dated Oct. 7, 2011 issued in U.S. Appl. No. 11/938,086.
U.S. Office Action dated Oct. 5, 2011 issued in U.S. Appl. No. 12/245,490.
U.S. Office Action Final dated Nov. 8, 2011 issued in U.S. Appl. No. 10/755,598.
U.S. Notice of Allowance dated Sep. 12, 2011 issued in U.S. Appl. No. 11/938,151.
U.S. Office Action Final dated Aug. 11, 2011 issued in U.S. Appl. No. 11/858,849.
U.S. Office Action (Advisory Action) dated Dec. 2, 2011 issued in U.S. Appl. No. 11/858,849.
U.S. Notice of Allowance and Allowability dated Dec. 14, 2011 issued in U.S. Appl. No. 11/858,849.
U.S. Office Action dated Nov. 18, 2011 issued in U.S. Appl. No. 11/858,700.
U.S. Office Action dated Nov. 28, 2011 issued in U.S. Appl. No. 11/858,695.
U.S. Notice of Allowance dated Oct. 12, 2011 issued in U.S. Appl. No. 11/858,793.
U.S. Notice of Allowance dated Nov. 21, 2011 issued in U.S. Appl. No. 11/858,693.
U.S. Office Action Final dated Sep. 6, 2011 issued in U.S. Appl. No. 11/849,119.
U.S. Office Action dated Oct. 4, 2011 issued in U.S. Appl. No. 11/549,258.
Australian Examiner's first report dated Jul. 25, 2011 issued in AU 2007289050.
Australian Examiner's first report dated Aug. 2, 2011 issued in AU 2007323945.
Australian Examiner's first report dated Jul. 25, 2011 issued in AU 2007324000.
Australian Examiner's First Report dated Aug. 4, 2011 issued in AU 2007323949.
Australian Examiner's first report dated Jul. 25, 2011 issued in AU 2007323994.
Australian Examiner's first report dated Aug. 2, 2011 issued in AU 2007338512.

Australian Examiner's first report dated Aug. 2, 2011 issued in AU 2007323964.
Australian Examiner's first report dated Nov. 30, 2011 issued in AU2007312986.
Australian Examiner's first report dated Aug. 19, 2011 issued in AU2007323962.
Australian Examiner's first report dated Jul. 29, 2011 issued in AU 2007323961.
GB Combined Search and Examination Report dated Nov. 18, 2011 issued in GB1113207.3.
Stic Search History, Patent Literature Bibliographic Databases, in a US Office Action dated Jul. 23, 2010 issued in U.S. Appl. No. 11/938,151, 98 pages.

* cited by examiner

SINGLE PLANE SPANNING MODE ACROSS INDEPENDENTLY DRIVEN DISPLAYS

CROSS REFERENCE TO RELATED APPLICATIONS

This application claims priority under 35 U.S.C. §119(e) to U.S. Provisional Patent Application No. 60/858,741, filed on Nov. 13, 2006 entitled "MULTIPLE LAYER DISPLAYS AND THEIR USE IN GAMING MACHINES", and U.S. Provisional Patent Application No. 60/986,995, filed on Nov. 9, 2007 entitled "SINGLE PLANE SPANNING MODE ACROSS INDEPENDENTLY DRIVEN DISPLAYS", both of which are incorporated by reference for all purposes.

TECHNICAL FIELD

The present invention relates generally to processor-based devices having multi-layer displays and more specifically the presentation of images displayed on each screen of a multi-layer display device.

BACKGROUND

Display technologies have progressed at a rapid rate in recent years, with the advent of plasma displays, flat panel displays, three-dimensional ("3-D") simulating displays and the like. Such advanced displays can be used for televisions, monitors, and various other electronics and processor-based devices. Processor-based gaming machines adapted to administer a wager-based game are but one particular example of the kind of specialized electronic devices that can benefit from the use of such new and improved display technologies.

Recent advances in such display technologies include the development of displays having multiple layers of screens that are "stacked" or otherwise placed in front or back of each other to provide an overall improved visual presentation on a single combined display unit. Examples of such multi-layer displays include those that are commercially available from PureDepth, Inc. of Redwood City, Calif. The PureDepth technology incorporates two or more liquid crystal display ("LCD") screens into one physically combined display unit, where each LCD screen is separately addressable to provide separate or coordinated images between the LCD screens. Many of the PureDepth display systems include a high-brightened backlight, a rear image panel, such an active matrix color LCD, a diffuser, a refractor, and a front image plane, which devices are laminated to form a device "stack."

The basic nature of a multi-layer display using stacked screens strongly encourages at least some form of coordination between the various images on the multiple screens. While various images on each separate screen might be clear and comprehensible if each screen were used separately in a traditional single screen display format, independent, uncoordinated, and unsynchronized images and/or text on these screens when stacked together can result in an unintelligible mess to a viewer. Such independent and uncoordinated images and/or text tend to obscure or completely block each other in numerous locations, making the combined visual presentation dark and largely unreadable.

SUMMARY

The invention relates to multi-layer display devices and provides for the presentation of images to be displayed on each screen or other display of a multi-layer display device using one combined in-plane video image. This allows a single video card, processor, or other logic device to be used with the combined in-plane video image for a multi-layer display device without requiring the images to be synchronized or coordinated due to the use of multiple video cards, processors, or logic devices.

In one embodiment, a multi-layer display device may have a first display screen having a first resolution and adapted to present a first visual image thereon, a second display screen having a second resolution and adapted to present a second visual image thereon, the second display screen arranged relative to the first display screen such that a common line of sight passes through a portion of the first display screen to a portion of the second display screen, and a logic device configured to communicate with the first display screen and the second display screen and configured to receive a combined single visual image for display on the first and second display screens, the combined visual image having a first portion corresponding to the first visual image to be displayed on the first display screen and a second portion corresponding to the second visual image to be displayed on the second display screen, wherein the logic device is configured to transmit the first visual image to the first display screen and the second visual image to the second display screen.

In another embodiment, a method for presenting images in a multi-layer display device having a first display screen and a second display screen may comprise creating a combined single plane image, the single plane image having a first image portion corresponding to images to be displayed on the first display screen and a second image portion corresponding to images to be displayed on the second display screen, transmitting the first image portion to the first display screen, and transmitting the second image portion to the second display screen.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The accompanying drawings, which are incorporated into and constitute a part of this specification, illustrate one or more example embodiments and, together with the description of example embodiments, serve to explain the principles and implementations.

DETAILED DESCRIPTION

Embodiments are described herein in the context of a single plane spanning mode to be used across multiple display screens of a multi-layer display device. The following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In this application, numerous specific details are set forth in order to provide a thorough understanding of the present invention. However, the present invention may be practiced without some or all of these specific details. In other instances, well known process steps have not been described in detail in order not to obscure the present invention.

Reference will now be made in detail to some specific examples of the invention, including the best modes contemplated by the inventor for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

Similarly, the steps of the methods shown and described herein are not necessarily all performed (and in some implementations are not performed) in the order indicated. Moreover, some implementations of the methods discussed herein may include more or fewer steps than those shown or described.

Multi-Layer Displays

Figure 1A:
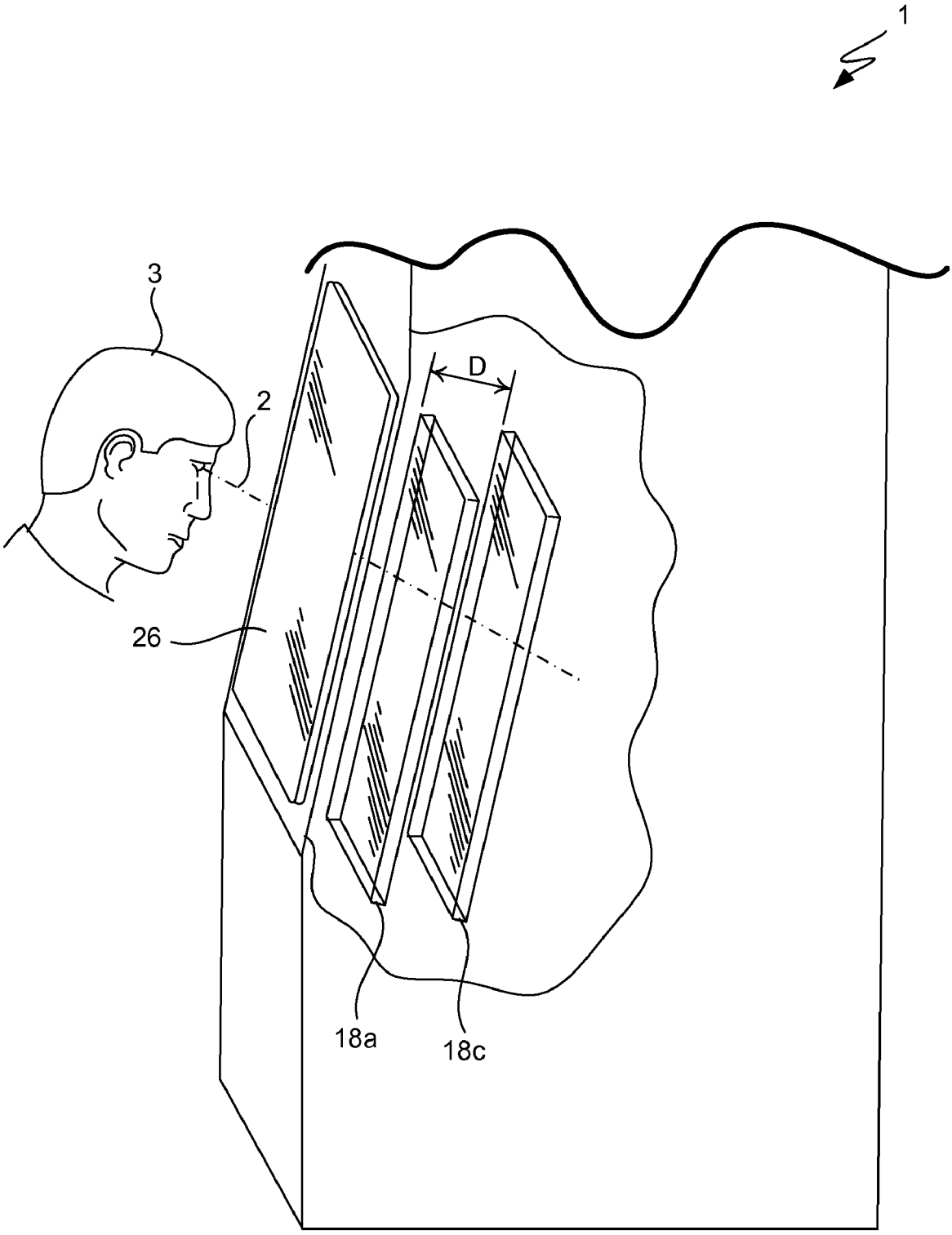
FIG. 1A illustrates in partial perspective and cut-away view an exemplary device having a multi-layer display with two display screens.
Figure 1B:
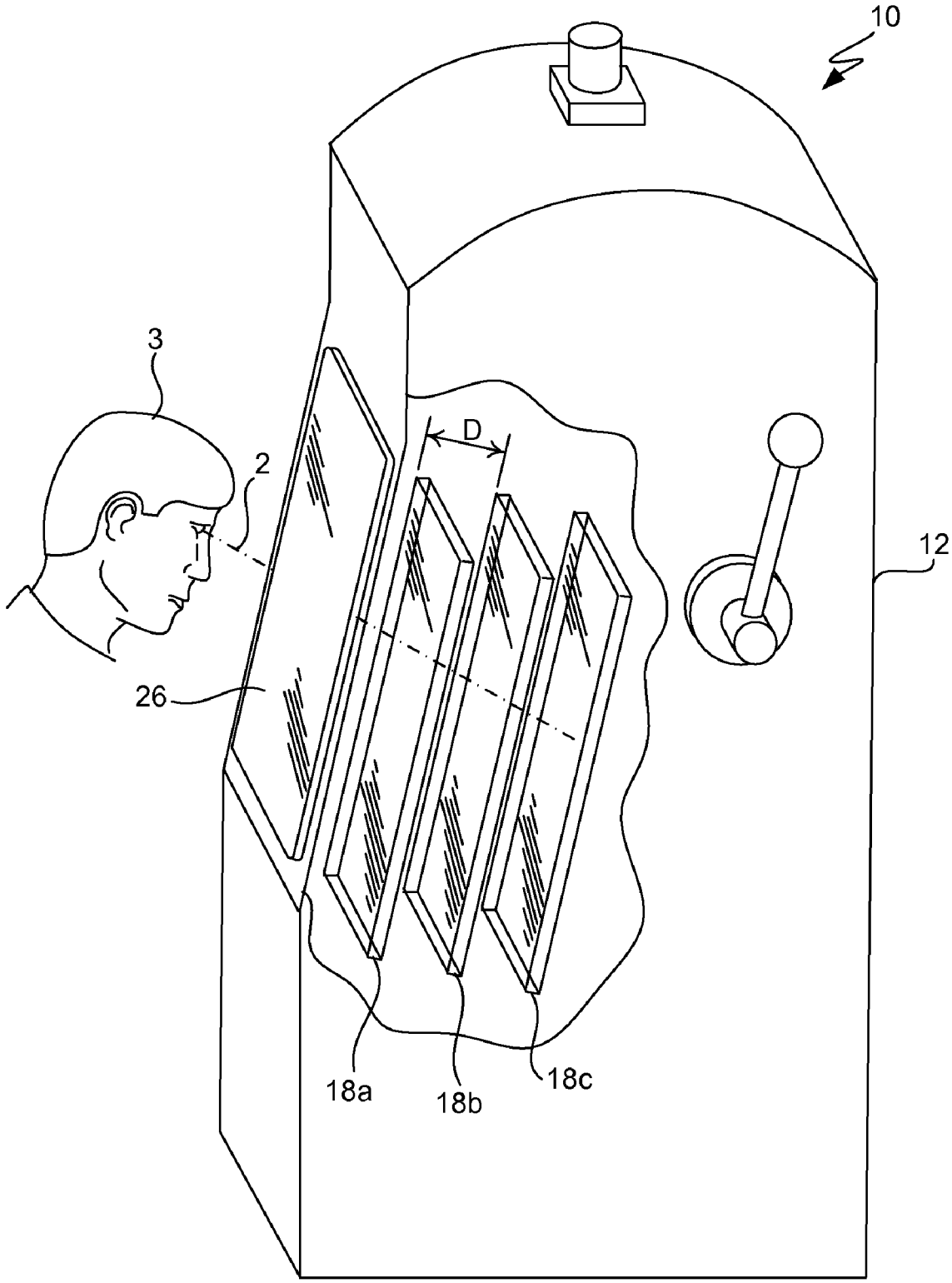
FIG. 1B illustrates in partial perspective and cut-away view an exemplary wager-based gaming machine having a multi-layer display with three display screens.

A general overview of multi-layer displays will first be provided. FIGS. 1A and 1B illustrate exemplary devices having multi-layer displays. FIG. 1A shows a generic device 1 having a multi-layer display with two display screens 18*a*, 18*c* positioned front-to-back, while FIG. 1B shows a wager-based gaming machine 10 having a multi-layer display with three display screens 18*a*, 18*b*, 18*c* positioned front-to-back. A predetermined spatial distance "D" separates display screens for the multi-layer displays. This predetermined distance, D, represents the distance from the display surface of display screen 18*a* to the display surface of an adjacent display screen (18*b* in FIG. 1B or 18*c* in FIG. 1A). This distance D may be adapted as desired by a multi-layer display manufacturer. In one embodiment, the display screens are positioned adjacent to each other such that only a thickness of the display screens separates the display surfaces. In this case, the distance D depends on the thickness of the exterior display screen. In a specific embodiment, distance "D" is selected to minimize spatial perception of interference patterns between the screens. Distance D can be adapted to improve perception of a three-dimensional display. Spatially separating the screens 18*a* and 18*c* allows a person to perceive actual depth between visual output on display screen 18*a* and visual output on rear display screen 18*c*.

Layered display devices (i.e., multi-layer displays) may be described according to their position along a common line of sight 2 relative to a viewer 3. As the terms are used herein, 'proximate' refers to a display screen that is closer to a person, along a common line of sight (such as 2 in FIG. 1A), than another display screen. Conversely, 'distal' refers to a display screen that is farther from a person, along the common line of sight 2, than another. While the layered displays of FIGS. 1A and 1B are shown set back from a touch screen 26, it will be understood that this is for illustrative purposes, such that the exterior display screen 18*a* may be closer to touch screen 26. Further, in some embodiments a touch screen may not be included, such that outer viewing surface 26 can merely be glass, plastic or another see-through material comprising a covering component. In other embodiments, no covering component 26 is provided, and the proximate display screen from the multi-layer display may be directly exposed to a viewer.

Under the control of an associated display processor, which may store visual data and/or also facilitate the transmission of display signals, display devices or screens 18*a*, 18*b*, 18*c* generate visual images and information for display to a person or player 3. The proximate display devices 18*a* and 18*b* each have the capacity to be partially or completely transparent or translucent. In a specific embodiment, the relatively flat and thin display devices 18*a* and 18*b* are LCDs. Other display technologies are also suitable for use. Various companies have developed relatively flat display devices that have the capacity to be transparent or translucent. One such company is Uni-Pixel Displays, Inc. of Houston Tex., which sells display screens that employ time multiplex optical shutter ("TMOS") technology. This TMOS display technology includes: (a) selectively controlled pixels that shutter light out of a light guidance substrate by violating the light guidance conditions of the substrate and (b) a system for repeatedly causing such violation in a time multiplex fashion. The display screens that embody TMOS technology are inherently transparent and they can be switched to display colors in any pixel area.

A transparent OLED may also be used. An electroluminescent display may also be suitable for use with proximate display devices 18*a* and 18*b*. Also, Planar Systems Inc. of Beaverton, Oreg. and Samsung, of Korea, both produce several display devices that are suitable for the uses described herein and that can be translucent or transparent. Kent Displays Inc. of Kent, Ohio also produces Cholesteric LCD display devices that operate as a light valve and/or a monochrome LCD panel. Other multi-layer display devices are discussed in detail in co-pending U.S. patent application Ser. No. 11/514,808, entitled "Gaming Machine With Layered Displays," filed Sep. 1, 2006, which is incorporated herein by reference in its entirety and for all purposes.

Regardless of the exact technology used, LCD or otherwise, it will be readily appreciated that each display screen or device 18*a*, 18*b*, 18*c* is generally adapted to present a graphical display thereupon based upon one or more display signals. While each display screen 18*a*, 18*b*, 18*c* is generally able to make its own separate visual presentation to a viewer, two or more of these display screens are positioned (i.e., "stacked") in the multi-layer display such that the various graphical displays on each screen are combined for a single visual presentation to a viewer.

The layered display screens 18 may be used in a variety of manners to present visual images to a user or player. In some cases, video data and other visual images displayed on the display devices 18*a* and 18*c* are positioned such that the images do not overlap (that is, the images are not superimposed). In other instances, the images do overlap. It should also be appreciated that the images displayed on the display screen can fade-in fade out, pulsate, move between screens, and perform other inter-screen graphics to create additional affects, if desired.

In another specific embodiment, layered display screens or devices 18 provide 3-D effects. Generic device 1 or gaming machine 10 may use a combination of virtual 3-D graphics on any one of the display screens—in addition to 3-D graphics obtained using the different depths of the layered display devices. Virtual 3-D graphics on a single screen typically involve shading, highlighting and perspective techniques that selectively position graphics in an image to create the perception of depth. These virtual 3-D image techniques cause the human eye to perceive depth in an image even though there is no real depth (the images are physically displayed on a single display screen, which is relatively thin). Also, the predetermined distance, D (between display screens for the layered display devices) facilitates the creation of 3-D effects having a real depth between the layered display devices. 3-D presentation of graphic components may then use a combination of: a) virtual 3-D graphics techniques on one or more of the multiple screens; b) the depths between the layered display devices; and c) combinations thereof. The multiple display devices may each display their own graphics and images, or cooperate to provide coordinated visual output. Objects and graphics in an overall visual presentation may then appear on any one or multiple of the display devices, where graphics or objects on the proximate screen(s) can block the view of graphics or objects on the distal screen(s), depending on the position of the viewer relative to the screens. This provides actual perspective between the graphical objects, which represents a real-life component of 3-D visualization (and not just perspective virtually created on a single screen).

Other effects and details may be used with respect to such multi-layer displays and their respective devices and systems, and it will be readily appreciated that such other effects and details may also be present with respect to the invention disclosed herein to be used with multi-layer displays, as may be suitable. In addition, although embodiments of multi-layer displays having two and three display screens have been presented and discussed, it will be readily appreciated that further display screens may be added to the multi-layer display in a similar manner. Such multi-layer displays could potentially have four, five or even more display screens arranged front-to-back in a relatively stacked arrangement, as in the case of the illustrated embodiments having two and three display screens.

Gaming Machines and Systems

Figure 2A:
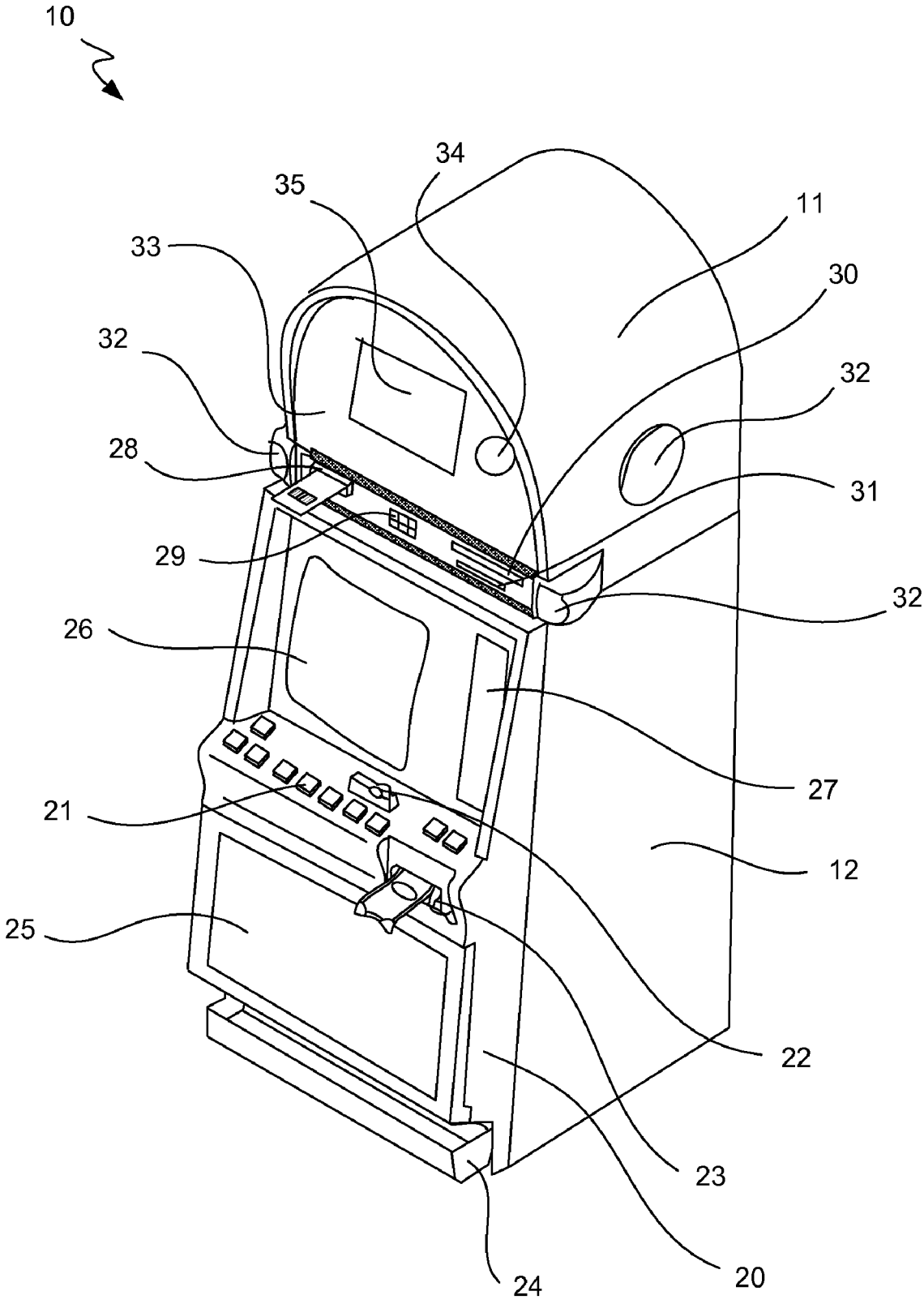
FIGS. 2A and 2B illustrate perspective views of an exemplary gaming machine.
Figure 2B:
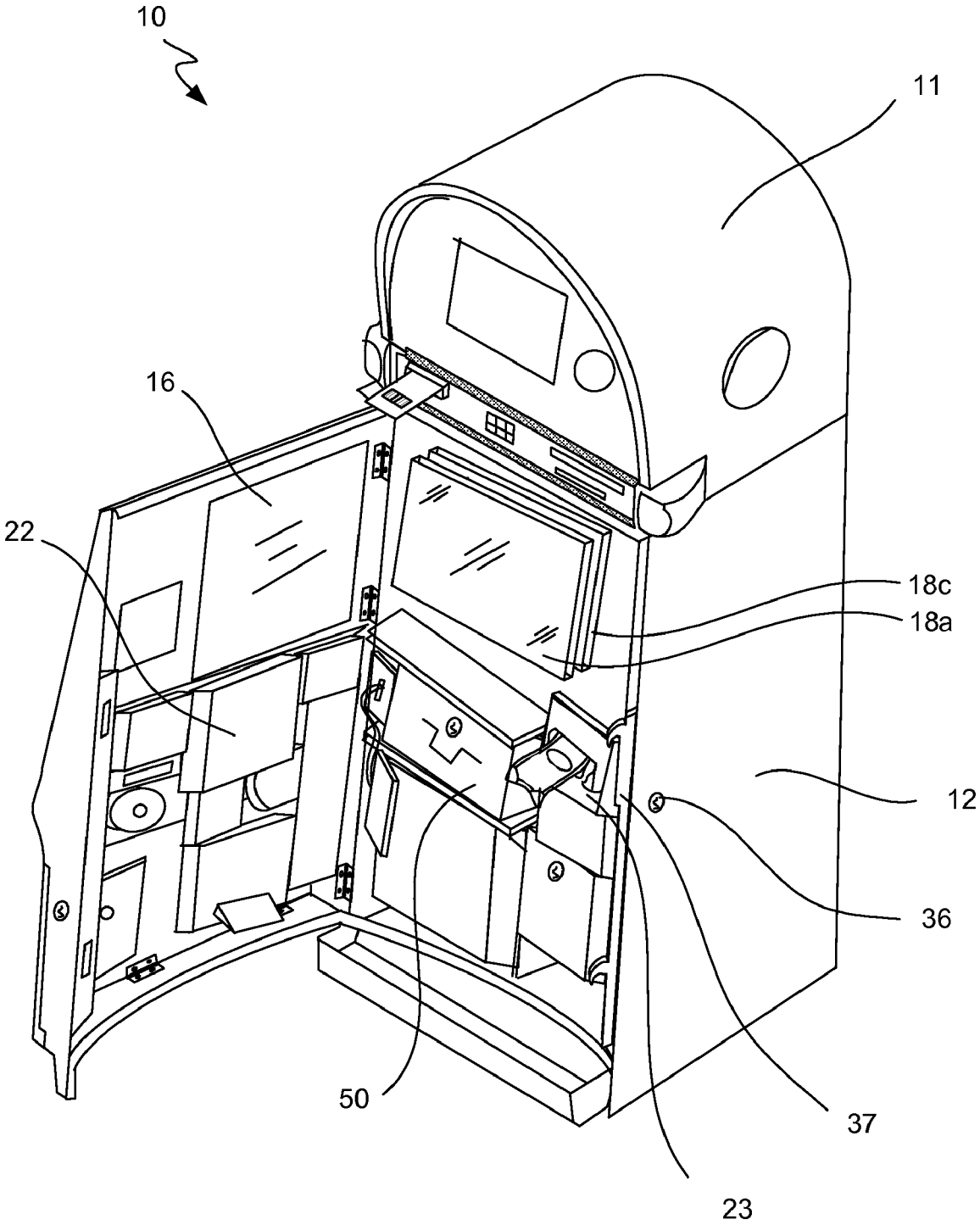

Referring next to FIGS. 2A and 2B, an exemplary processor-based gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, which collectively form a button panel, one or more money or credit acceptors, such as a coin acceptor 22 and a bill or ticket validator 23, a coin tray 24, and a belly glass 25. Viewable through main door 20 is a primary display monitor 26 adapted to present a game and one or more information panels 27. The primary display monitor 26 will typically be a cathode ray tube, high resolution flat-panel LCD, plasma/LED display or other conventional or other type of appropriate monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket dispenser 28, a key pad 29, one or more additional displays 30, a card reader 31, one or more speakers 32, a top glass 33, one or more cameras 34, and a secondary display monitor 35, which can similarly be a cathode ray tube, a high resolution flat-panel LCD, a plasma/LED display or any other conventional or other type of appropriate monitor. Alternatively, secondary display monitor 35 might also be foregone in place of other displays, such as gaming reels or physical dioramas that might include other moving components, such as, for example, one or more movable dice, a spinning wheel or a rotating display. It will be understood that many makes, models, types and varieties of gaming machines exist, that not every such gaming machine will include all or any of the foregoing items, and that many gaming machines will include other items not described above.

With respect to the basic gaming abilities provided, it will be readily understood that gaming machine 10 may be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. Other features and functions may also be used in association with gaming machine 10, and it is specifically contemplated that the present invention can be used in conjunction with such a gaming machine or device that might encompass any or all such additional types of features and functions. In various preferred embodiments, gaming machine 10 can be adapted to present a video simulation of a reel based game involving a plurality of gaming reels.

Although a generic gaming machine 10 has been illustrated in FIG. 2A, it will be readily appreciated that such a wager-based gaming machine can include a multi-layer display, such as that shown in FIG. 1A and illustrated in FIG. 2B. With reference to FIG. 2B, the gaming machine of FIG. 2A is illustrated in perspective view with its main door opened. In addition to the various exterior items described above, such as top box 11, main cabinet 12 and primary displays 18, gaming machine 10 may also comprise a variety of internal components. As will be readily understood by those skilled in the art, gaming machine 10 may contain a variety of locks and mechanisms, such as main door lock 36 and latch 37. Internal portions of coin acceptor 22 and bill or ticket scanner 23 can also be seen, along with the physical meters associated with these peripheral devices. Processing system 50 may include computer architecture, as will be discussed in further detail below.

When a person wishes to play a gaming machine 10, he or she provides coins, cash or a credit device to a scanner included in the gaming machine. The scanner may comprise a bill scanner or a similar device configured to read printed information on a credit device such as a paper ticket or magnetic scanner that reads information from a plastic card. The credit device may be stored in the interior of the gaming machine. During interaction with the gaming machine, the person views game information using a display. Usually, during the course of a game, a player is required to make a number of decisions that affect the outcome of the game. The player makes these choices using a set of player-input switches. A game ends with the gaming machine providing an outcome to the person, typically using one or more of the displays.

After the player has completed interaction with the gaming machine, the player may receive a portable credit device from the machine that includes any credit resulting from interaction with the gaming machine. By way of example, the portable credit device may be a ticket having a dollar value produced by a printer within the gaming machine. A record of the credit value of the device may be stored in a memory device provided on a gaming machine network (e.g., a memory device associated with validation terminal and/or processing system in the network). Any credit on some devices may be used for further games on other gaming machines 10. Alternatively, the player may redeem the device at a designated change booth or pay machine.

Gaming machine 10 can be used to play any primary game, bonus game, progressive or other type of game. Other wagering games can enable a player to cause different events to occur based upon how hard the player pushes on a touch screen. For example, a player could cause reels or objects to move faster by pressing harder on the exterior touch screen. In these types of games, the gaming machine can enable the player to interact in the 3D by varying the amount of pressure the player applies to a touch screen.

As indicated above, gaming machine 10 also enables a person to view information and graphics generated on one display screen while playing a game that is generated on another display screen. Such information and graphics can include game paytables, game-related information, entertaining graphics, background, history or game theme-related information or information not related to the game, such as advertisements. The gaming machine can display this information and graphics adjacent to a game, underneath or behind a game or on top of a game. For example, a gaming machine could display paylines on a proximate display screen and also display a reel game on a distal display screen, and the paylines could fade in and fade out periodically.

Figure 2C:
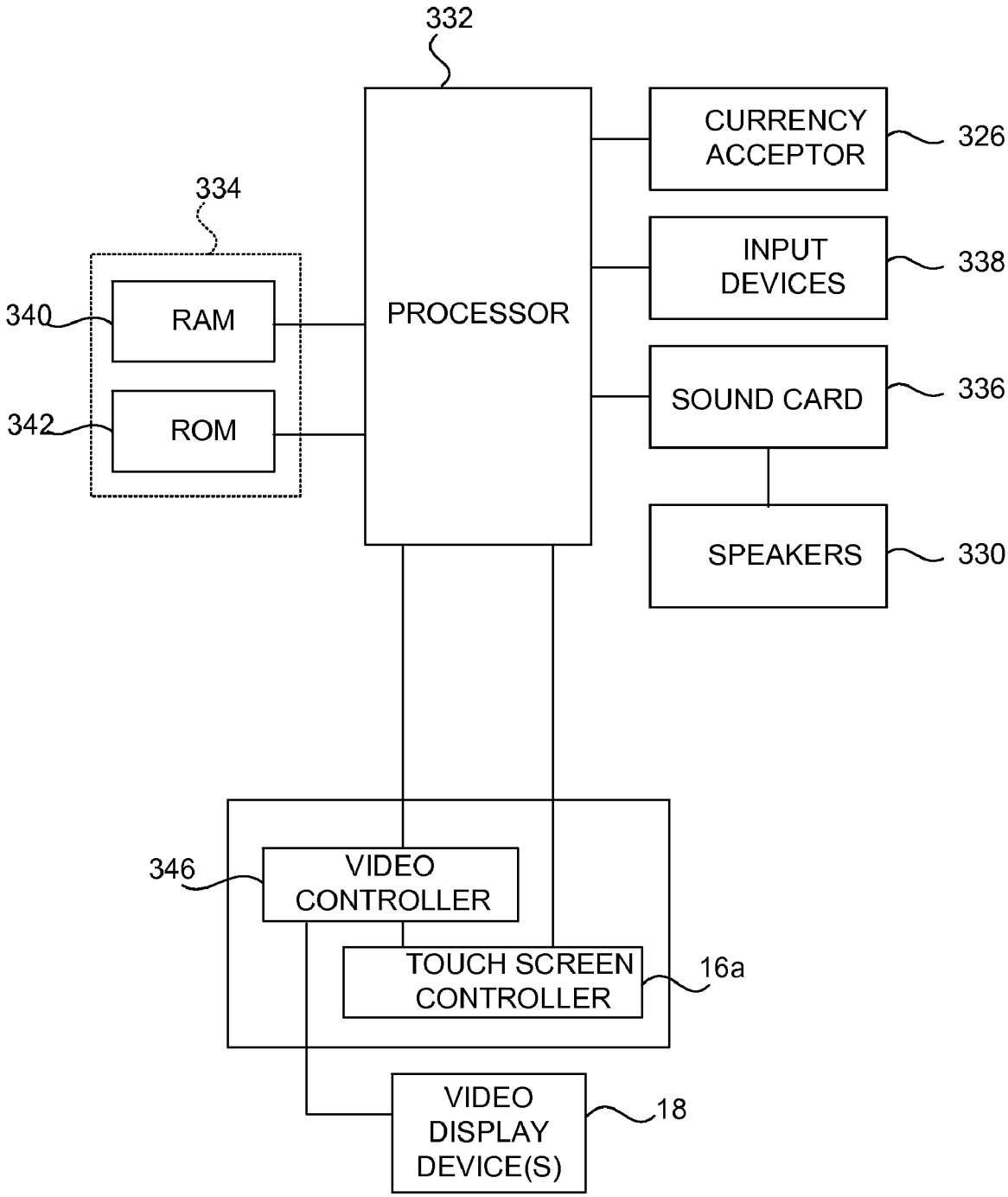
FIG. 2C illustrates in block diagram format an exemplary control configuration for use in a gaming machine according to various embodiments of the present invention.

A gaming machine includes one or more processors and memory that cooperate to output games and gaming interaction functions from stored memory. FIG. 2C illustrates a block diagram of a control configuration for use in a gaming machine. Processor 332 is a microprocessor or microcontroller-based platform that is capable of causing a display system 18 to output data such as symbols, cards, images of people, characters, places, and objects which function in the gaming device. Processor 332 may include a commercially available microprocessor provided by a variety of vendors known to those of skill in the art. Gaming machine 10 may also include one or more application-specific integrated circuits (ASICs) or other hardwired devices. Furthermore, although the processor 332 and memory device 334 reside on each gaming machine, it is possible to provide some or all of their functions at a central location such as a network server for communication to a playing station such as over a local area network (LAN), wide area network (WAN), Internet connection, microwave link, and the like.

Memory 334 may include one or more memory modules, flash memory or another type of conventional memory that stores executable programs that are used by the processing system to control components in a layered display system and to perform steps and methods as described herein. Memory 334 can include any suitable software and/or hardware structure for storing data, including a tape, CD-ROM, floppy disk, hard disk or any other optical or magnetic storage media. Memory 334 may also include a) random access memory (RAM) 340 for storing event data or other data generated or used during a particular game and b) read only memory (ROM) 342 for storing program code that controls functions on the gaming machine such as playing a game.

A player may use one or more input devices 338, such as a pull arm, play button, bet button or cash out button to input signals into the gaming machine. One or more of these functions could also be employed on a touch screen. In such embodiments, the gaming machine includes a touch screen controller 16*a* that communicates with a video controller 346 or processor 332. A player can input signals into the gaming machine by touching the appropriate locations on the touch screen.

Processor 332 communicates with and/or controls other elements of gaming machine 10. For example, this includes providing audio data to sound card 336, which then provides audio signals to speakers 330 for audio output. Any commercially available sound card and speakers are suitable for use with gaming machine 10. Processor 332 is also connected to a currency acceptor 326 such as the coin slot or bill acceptor. Processor 332 can operate instructions that require a player to deposit a certain amount of money in order to start the game.

Although the processing system shown in FIG. 2C is one specific processing system, it is by no means the only processing system architecture on which embodiments described herein can be implemented. Regardless of the processing system configuration, it may employ one or more memories or memory modules configured to store program instructions for gaming machine network operations and operations associated with layered display systems described herein. Such memory or memories may also be configured to store player interactions, player interaction information, and other instructions related to steps described herein, instructions for one or more games played on the gaming machine, etc.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

The processing system may offer any type of primary game, bonus round game or other game. In one embodiment, a gaming machine permits a player to play two or more games on two or more display screens at the same time or at different times. For example, a player can play two related games on two of the display screens simultaneously. In another example, once a player deposits currency to initiate the gaming device, the gaming machine allows a person to choose from one or more games to play on different display screens. In yet another example, the gaming device can include a multi-level bonus scheme that allows a player to advance to different bonus rounds that are displayed and played on different display screens.

Also, as noted above, a wide variety of devices can be used with the disclosed specialized multi-layer displays and systems, and such devices are not limited to gaming machines. While such gaming machines will be further described with respect to a gaming network or system, it will be readily appreciated that alternative devices having multi-layer displays may also be included in a similar network or system.

General Gaming Network And System Configurations

Figure 3:
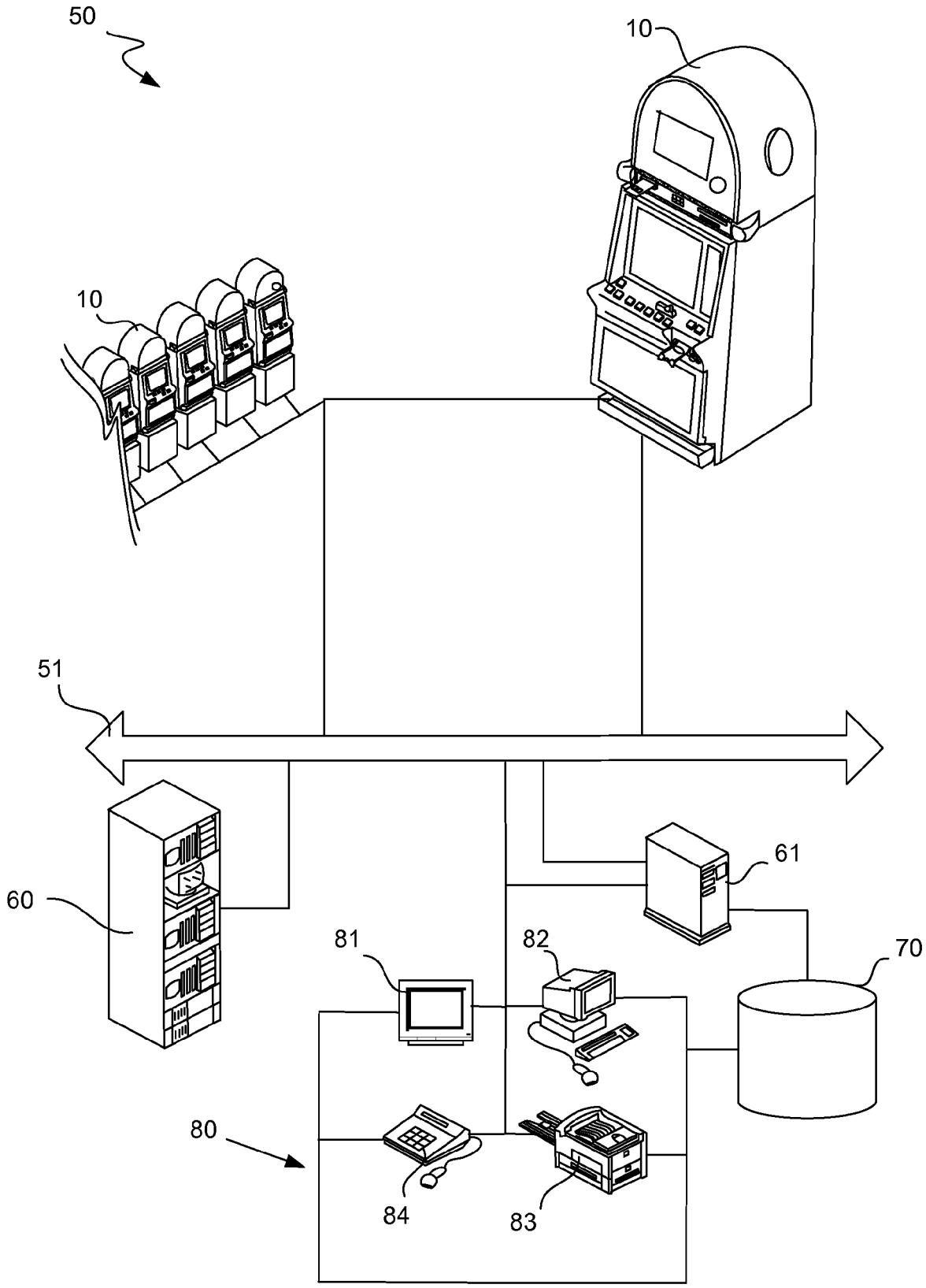
FIG. 3 illustrates in block diagram format an exemplary network infrastructure for providing a gaming system having one or more gaming machines according to one embodiment of the present invention.

Continuing with FIG. 3, an exemplary network infrastructure for providing a gaming system having one or more gaming machines is illustrated in block diagram format. Exemplary gaming system 50 has one or more gaming machines, various communication items, and a number of host-side components and devices adapted for use within a gaming environment. As shown, one or more gaming machines 10 adapted for use in gaming system 50 can be in a plurality of locations, such as in banks on a casino floor or standing alone at a smaller non-gaming establishment, as desired. Common bus 51 can connect one or more gaming machines or devices to a number of networked devices on the gaming system 50, such as, for example, a general-purpose server 60, one or more special-purpose servers 61, a sub-network of peripheral devices 80, and/or a database 70.

A general-purpose server 60 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other visual data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 50 contains one or more special-purpose servers that can be used for various functions relating to the provision of gaming machine administration and operation under the present methods and systems. Such a special-purpose server or servers could include, for example, a cashless gaming server, a player verification server, a general game server, a downloadable games server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 50 can be isolated from any other network at the establishment, such that a general-purpose server 60 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more displays 81, one or more user terminals 82, one or more printers 83, and one or more other input devices 84, such as a ticket validator or other security identifier, among others. Similarly, under either embodiment of an isolated or shared network, at least the specialized server 61 or another similar component within a general-purpose server 60 also preferably includes a connection to a database or other suitable storage medium 70. Database 70 is preferably adapted to store many or all files containing pertinent data or information for a particular purpose, such as, for example, data regarding visual image data, video clips, other displayable items, and/or related data, among other potential items. Files, data and other information on database 70 can be stored for backup purposes, and are preferably accessible at one or more system locations, such as at a general-purpose server 60, a special purpose server 61 and/or a cashier station or other sub-network location 80, as desired.

In some embodiments, one or both of general-purpose server 60 and special purpose server 61 can be adapted to download various games and/or to transmit video, visual images, or other display signals to one or more gaming machines 10. Such downloaded games can include reel-based slots type games. Such downloads of games or transmission of video, visual images, or other display signals can occur based on a request or command from a player or a casino operator, or can take place in an automated fashion by system 50, such as via a particular prompt or trigger. In the event that display signals are transmitted, such display signals may include one or more signals intended for use on a multi-layer display.

While gaming system 50 can be a system that is specially designed and created new for use in a casino or gaming establishment, it is also possible that many items in this system can be taken or adopted from an existing gaming system. For example, gaming system 50 could represent an existing cashless gaming system to which one or more of the inventive components or controller arrangements are added, such as controllers, storage media, and/or other components that may be associated with a dynamic display system adapted for use across multiple gaming machines and devices. In addition to new hardware, new functionality via new software, modules, updates or otherwise can be provided to an existing database 70, specialized server 61 and/or general-purpose server 60, as desired. Other modifications to an existing system may also be necessary, as might be readily appreciated.

Single Plane Spanning Across Multiple Display Screens

As noted above, one problem that can be encountered with a typical multi-layer display device is the difficulty in viewing anything on the combined overall visual presentation whenever the first, second and/or additional graphical or visual displays on each of the individual screens are not coordinated or synchronized, or do not otherwise readily permit the view of displays on each screen. That is, whenever even one of the display screens within a stack of multi-layer display screens presents its own images without regard to what might be on any of the other display screens, it can be difficult or impossible to view anything at all.

Figure 4A:
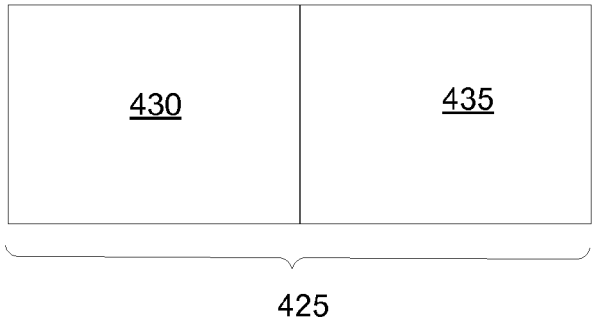
FIGS. 4A through 4C illustrate exemplary single plane spanning techniques for the presentation of images displayed on each screen of a multi-layer display device according to various embodiments of the present invention.
Figure 4B:
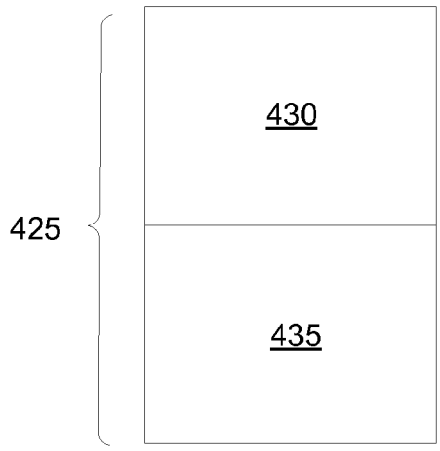
Figure 4C:
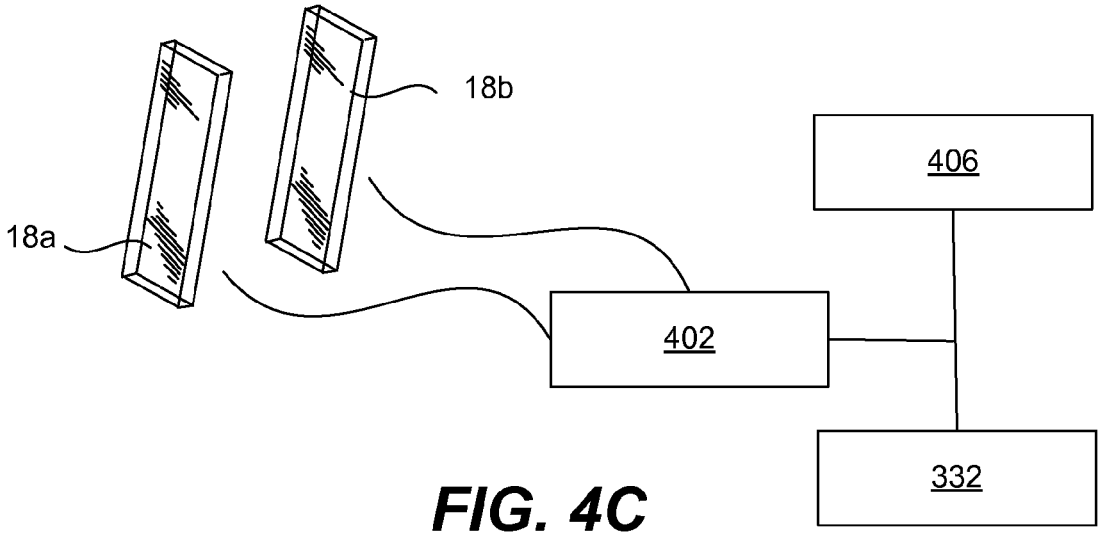

FIGS. 4A through 4C illustrate exemplary single plane spanning techniques for the presentation of images displayed on each screen of a multi-layer display device. FIG. 4A illustrates a horizontal spanning mode and FIG. 4B illustrates a vertical spanning mode. A combined in-plane video space 425 may have a first portion 430 that may contain video data or other visual images to be displayed on a corresponding front display screen and a second portion 435 that may contain video data or other visual images to be displayed on a corresponding back display screen. In this embodiment, a horizontal spanning mode is illustrated since the first portion 430 is positioned adjacent the second portion 435 in a side-by-side orientation. Although only two portions representing two multi-layer display screens are shown for purposes of illustration, it will be readily appreciated that images for one or more additional display screens may also be provided on the combined in-plane video space 425. For example, combined in-plane video space 425 may include a third portion (not shown) positioned in a side-by-side orientation adjacent the second portion 435 that may contain video data or other visual images to be displayed on a corresponding third display screen.

The size of combined in-plane video space 425 may vary. Pixel dimensions or the resolution may be matched to each multi-layer display screen size. For example, if both the front and back display screens each have a 1820×1074 resolution, then combined single plane video space 425 may have a 3640×1074 resolution.

In one embodiment, this may enable the use of a single logic device or controller 402 for the multi-layer displays as illustrated in FIG. 4C. Logic device may be a processor, a programmable logic device, video card having dual output ports, or the like. Screens 18 may be configured to communicate with a single controller 402. Controller 402 may be configured to communicate with other logic devices, such as processor 332. The display controller 402 may receive data and/or display signals from the processor 332. The display controller 402 may also be in communication with a video processor 406 to receive data and/or display signals such as video graphic images to display on the display devices 18*a*, 18*b*. A more detailed description of the controller 402 is also provided in co-pending patent application Ser. No. 11/858,849, filed Sep. 20, 2007, entitled "Auto-blanking Screen For Devices Having Multi-Layer Displays", which is hereby incorporated by reference in its entirety for all purposes.

In one example, a single graphics chip may be used to drive both the front display screen and the back display screen. In a specific embodiment, the combined in-plane video space 425 may be programmed in Adobe Flash and implemented by an nVIDIA GeForce graphics chipsets that provide "horizontal spanning" or "vertical spanning".

Use of a single logic device or controller reduces cost and complexity for a gaming machine or other electronic devices and may be used on a gaming machine or other electronic device with very limited resources. Furthermore, use of a single controller may allow for better graphic designs, as one single image and/or animation may be designed and programmed to run natively according to the resolution of the combined in-plane video space, which may be at the resolution of the front display and/or the back display rather than designing two or more separate display images for separate controllers to run each individual multi-layer display.

Combined in-plane video space 425 may allow a single video display device (e.g., using a single video card, processor, and the like) to drive a 3-D display device with multiple layer display panels. This combined in-plane video space 425 may assist in the development of the video or other visual image output for front and back multi-layer displays since a single animation may be used. For example, only one timing series or sequence need be created and maintained—rather than two animations that need to be synchronized in time if the two displays were animated using separate video cards, processors, or the like. This also allows games to be developed using this single plane spanning technique where the video or other visual image output of each section in the combined in-plane video space 425 may used to drive a separate display.

Although first portion 430 and second portion 435 are arranged adjacent in a side-by-side orientation in FIG. 4A, other arrangements are suitable for use. For example, the first portion 430 may be positioned above the second portion 435 as illustrated in FIG. 4B. In other words, similar results may also be achieved using "vertical spanning" whereby the image could also wrap around from top to bottom with the appropriate resolution settings. In another example, first portion 430 may be positioned below second portion 435.

Figure 5A:
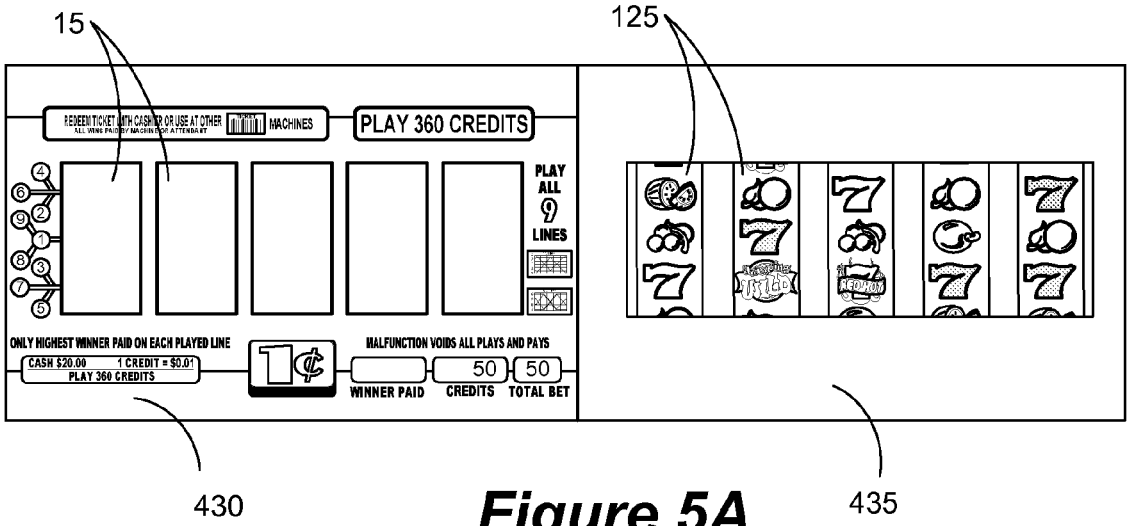
FIG. 5A illustrates an exemplary video output on a single display screen in a horizontal spanning mode.
Figure 5B:
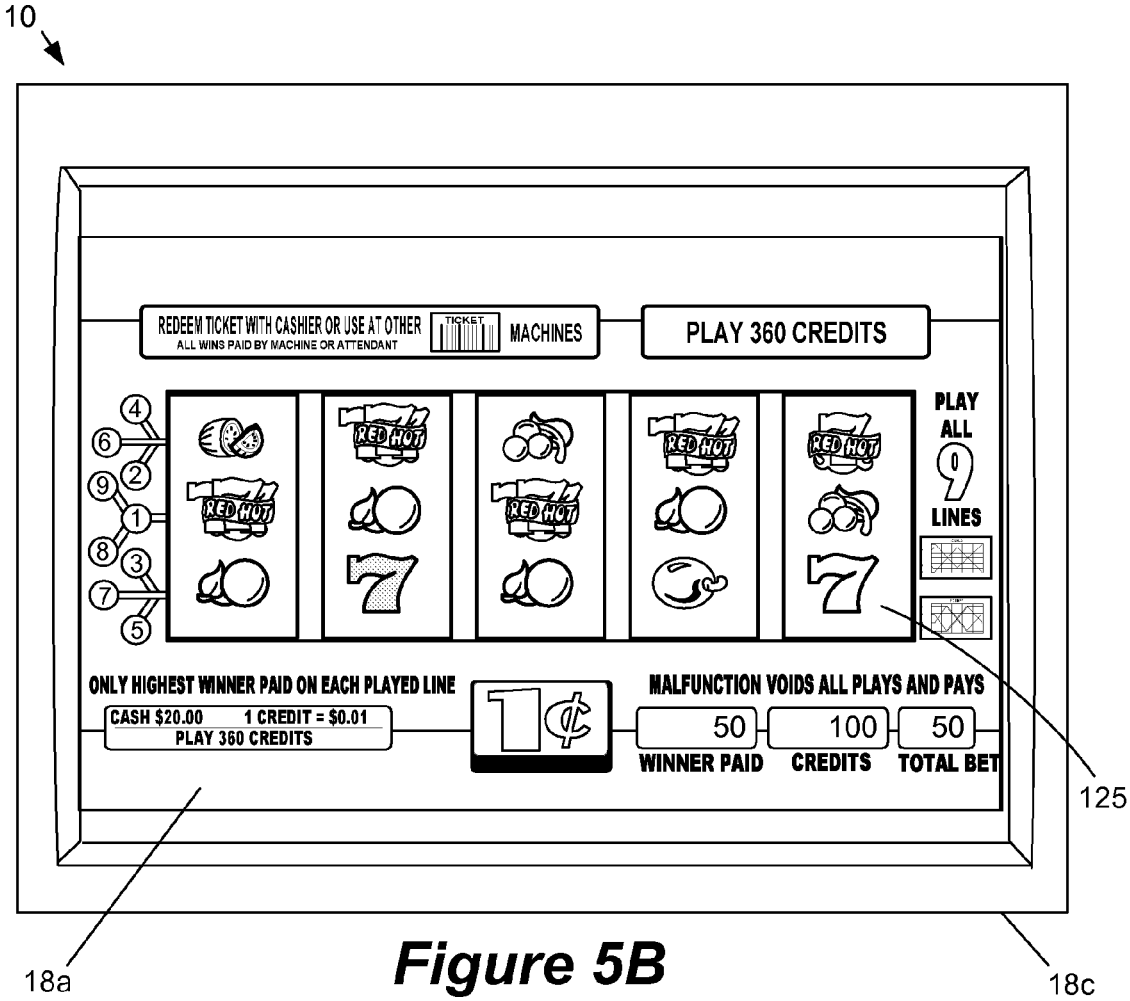
FIG. 5B illustrates the exemplary video output of FIG. 5A on a multi-layer display device.

When displayed on the front and back display devices, the images may wrap around on the two separate screens, albeit without knowledge or perception by a person standing in front of the layered displays as illustrated in FIGS. 5A and 5B. In one embodiment, the images from the combined in-plane video space 425 may be transferred to a single display. This may allow a programmer, graphics artist, maintenance personnel, or the like to easily view the images and design or service the multi-layer display device.

FIG. 5A illustrates an exemplary video output of a display in a horizontal spanning mode onto a single display screen. Although illustrated on a single display screen, this embodiment is not intended to be limiting as the visual images may be displayed among several display screens as illustrated with reference to FIG. 5B. In another embodiment, the combined in-plane video space may be down-sampled to fit a single display device (e.g., an LCD panel).

FIG. 5A illustrates a combined in-plane video space having images resembling traditional mechanical reels. In one embodiment, first portion 430 may transfer images corresponding to front display screen 18*a*, which includes transparent window portions 15 that permit viewing of the virtual slot reels that are shown on the second portion 435 or back display screen 18*c*. Second portion 430 may transfer images corresponding to back display screen 18*c* which includes the video reel 125. In another embodiment, the combined image may be transmitted and displayed on the front display device. Should the image size exceed the resolution or size of the first display device, the remaining images may wrap around to the back display device.

FIG. 5B illustrates the images from FIG. 5A as would be seen by a user in a multi-layer display device. Front display screen 18*a* outputs video or other visual image data that resembles a silk-screened glass, while the back display screen 18*c* displays five video reels 125. Images on first portion 430 may correspond to images displayed on front screen 18*a* and images on second portion 435 may correspond to images displayed on back screen 18*c*.

Video data or other visual images provided to screen 18*a* and 18*c* is configured such that a common line of sight passes through each window portion 15 of front display screen 18*a* to a video reel 125 of the back display screen 18*c*. Single plane spanning of the images on the first portion 430 and second portion 435 allows a user to simultaneously view the images on the multiple screens of a multi-layer display device without requiring the images to be coordinated or synchronized, such as when the images are provided separately by multiple video cards, processors, or logic devices.

Figure 6A:
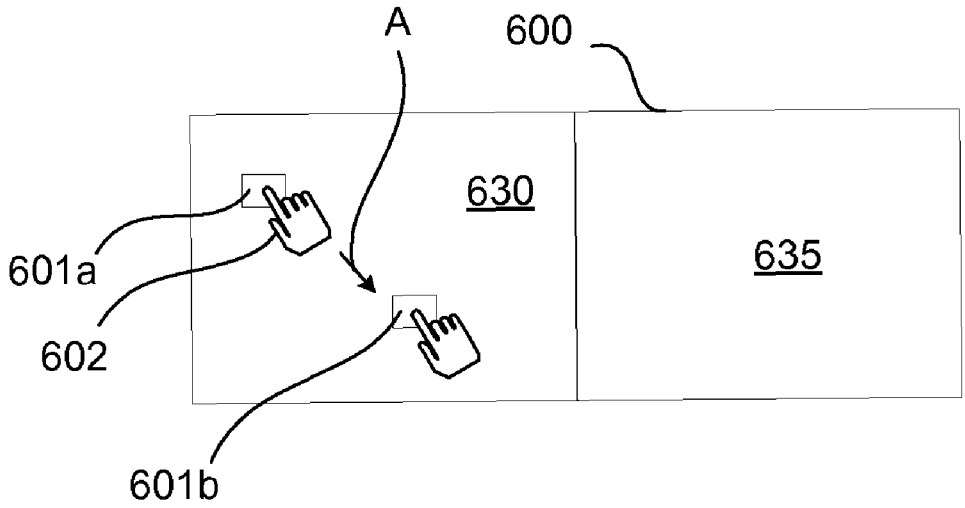
FIGS. 6A and 6B illustrate an exemplary pointer when images from the combined in-plane video space are viewed in a horizontal spanning mode according to one embodiment of the present invention.
Figure 6B:
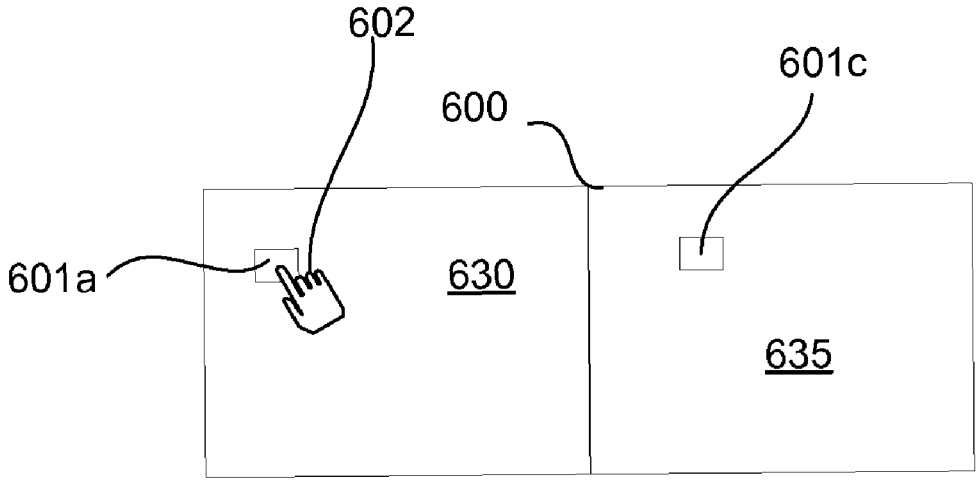

FIGS. 6A and 6B illustrate an exemplary pointer when images from the combined in-plane video space are viewed in a horizontal spanning mode, such as in FIGS. 5A and 5B. When the combined in-plane video space is used with a touch screen, mouse, or any other input device, a difficulty with the software configuration may be that movement of input on the touch screen may no longer match dimensions of the combined in-plane video space. In other words, movement of a pointer 601 on the touch screen 600 occurs in the resolution of the touch screen, which usually matches the front display screen in a multi-layer display device. The term pointer used herein is intended to be any type of indicator on a display screen, such as a cursor. The input from the pointer may be received using any input device such as a touch screen, mouse, keyboard, or any other similar device.

However, the combined in-plane video space includes double the horizontal resolution of the front display 600. This mismatch distorts and ruins the touch screen input since the user's actions are not accurately reflected in the output image.

For example, as illustrated in FIG. 6A, a user 602 may want to move pointer 601*a* in the direction of arrow A to the new location of pointer 601*b* within first display portion 630. First display portion may correspond to images to be displayed on a front display screen of a multi-layer display device. For exemplary purposes only and not intended to be limiting, the resolution of the touch screen 600 may be 1680×840 and combined in-plane video space may have a resolution of 3360×840. Thus, the pointer 601*a* will move at twice its normal speed and the pointer location 600*c* will end up displayed on second display portion 635 as illustrated in FIG. 6B. Second display portion may correspond to images to be displayed on a back display screen of a multi-layer display device To correct for this mismatch, the pointer may be calibrated in order to reduce its speed and/or movement. In one embodiment, the gaming machine stores and uses a calibration routine that translates between the resolution differences of the front display 630 and the combined in-plane video space. In some cases, this may occur without altering the conventional operating system, such as Windows®. The calibration software may then functionally reside between the input and the input to the processor 332. More specifically, the calibration software may receive an input from the touch screen display, mouse, or any other input device, alter the input to match the combined in-plane video space resolution, and provide the new altered pointer location to the operating system.

For example, the pointer 601*a* may move from its original position to a first distance in a horizontal direction and a second distance in a vertical direction. As the pointer 601*a* moves, the first distance may be reduced by a ratio of the first display screen resolution and the resolution of the combined in-plane video space 425. In this example, the first distance may be reduced by a factor of two or reduced to half the distance since 1680/3360=½. In other words, the first distance may be reduced by a ratio of the touch screen 600 resolution and the combined in-plane video space resolution. By reducing the distance, the pointer 601*a* will end up at pointer location 600*b*.

In a vertical spanning mode, the pointer may have a similar, but different calibration. In a vertical spanning mode, the second distance or vertical direction may be reduced by a factor of two. In other words, the second distance may be reduced by a ratio of a vertical component of the touch screen 600 resolution and a vertical component of the combined in-plane video space resolution.

The example discussed herein illustrates the use of the pointer when images from the combined in-plane video space are displayed on a single screen as illustrate in FIG. 5A. However, it will be appreciated that the same result occurs when the images are presented in a multi-layer display device as illustrated in FIG. 5B. For example, if the pointer is not calibrated, it may move from the front display screen 18*a* to the back display screen 18*c*.

It will know be known that the pointer may be altered or calibrated in other ways in order to correct for the mismatch and the examples set forth above are not intended to be limiting. For example, the calibration software may limit the pointer movements to the front display, despite differences between the front display resolution and the resolution for the combined in-plane video space. In another example, if the combined in-plane video space has three portions in a horizontal spanning mode, representing three display screens in a multi-layer display device, the first distance may be reduced by a ratio of the first display screen resolution and the resolution of the combined in-plane video space, which may be ⅓.

Figure 7:
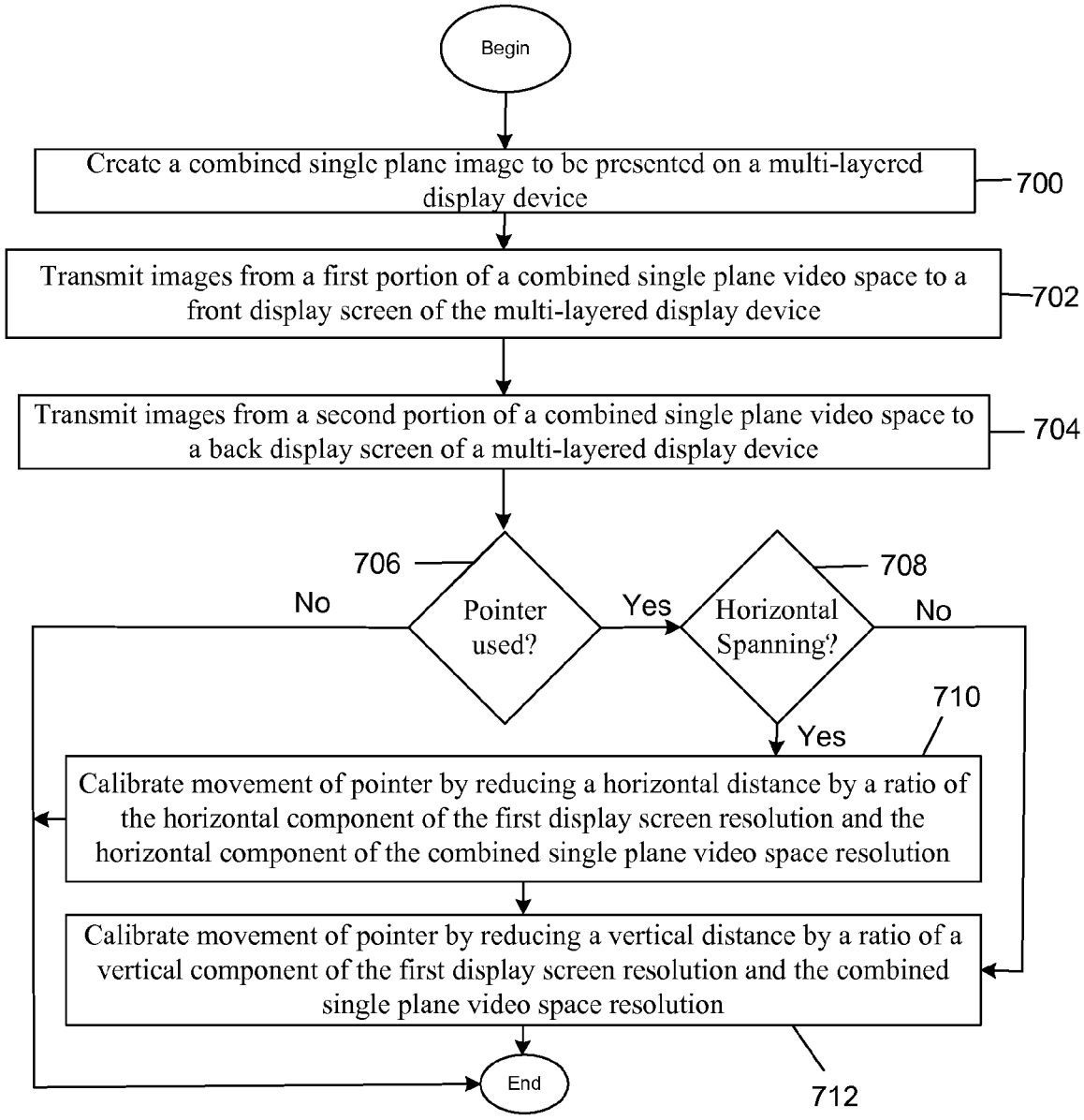
FIG. 7 illustrates a flowchart of an exemplary method for presenting images displayed on each screen of a multi-layer display device according to one embodiment of the present invention.

FIG. 7 illustrates a flowchart of an exemplary method for presenting images on each screen of a multi-layer display device. It will be readily appreciated that the method and illustrative flowchart provided herein are merely exemplary, and that the present invention may be practiced in a wide variety of suitable ways. While the provided flowchart may be comprehensive in some respects, it will be readily understood that not every step provided is necessary, that other steps can be included, and that the order of steps might be rearranged as desired.

A single video data or visual image signal may be created for presentation on a multi-layer display device at 700. As noted above, the single video data or visual image signal may be a combined in-plane video space that may allow a single video display device (e.g., using a single video card, processor, and the like) to drive a 3-D display device with multiple layer display panels. This combined in-plane video space may assist in the development of the video or other visual image output for front and back multi-layer displays since a single video data or visual image signal may be created rather than many individual visual image signals.

The combined single plane video space may be used having a first portion that may transfer video data or other visual images to be displayed on a corresponding front display screen at 702 and a second portion that may transfer video data or other visual images to a corresponding back display screen at 704. The combined single plane video space may be in any known single plane spanning mode, such as in a horizontal spanning mode, where the first portion is positioned adjacent, in a side-by-side orientation, the second portion, or in a vertical spanning mode where the first portion is above the second portion. Although only two portions representing two multi-layer display screens are shown for purposes of illustration, it will be readily appreciated that images for one or more additional display screens may also be provided on the combined in-plane video space.

Use of the combined single plane video space allows for the use of a single logic device or controller to present displayed images to all multi-layer display screens. This can reduce cost and complexity for a gaming machine and may be used on a gaming machine with very limited resources. Furthermore, use of a single controller allows for better graphic designs, as one single image and/or animation may be designed and programmed to run natively according to the resolution of the combined in-plane video space, which may be the combined resolution of the front display and the back display, rather than designing two separate display images for a separate controller for each individual multi-layer display screen.

When the combined single plane video space is used with a pointer, touch screen, mouse, or any other input device at 706, a difficulty with the software configuration may be that movement of input on the touch screen does not match dimensions of the combined single plane video space. Thus, movement of a pointer on the screen may be distorted or mismatched. If the combined in-plane video space is in a horizontal spanning mode at 708, the pointer may be calibrated by reducing the horizontal distance of the pointer by a ratio of a horizontal component of the first display resolution and a horizontal component of the overall combined single plane video space resolution at 710. If the screen is not in a horizontal spanning mode at 708 (e.g. in a vertical spanning mode), the pointer may be calibrated by reducing the vertical distance of the pointer by a ratio of the vertical component of the first display resolution and a vertical component of the overall combined single plane video space resolution at 712. It will be known that the horizontal and vertical components correspond to the horizontal and vertical component of a resolution. For example, a screen having a resolution of 1820×1074 will have a horizontal component of 1820 and a vertical component of 1074. Generally, this prevents the pointer from moving at its normal speed since the screen may be set at a higher resolution.

While the foregoing method has been described with respect to specific screen resolutions they are not intended to be limiting as any resolution may be used. Additionally, although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A display system configured to display images on a single screen that are also adapted for a three-dimensional display on an associated multi-layer display device having a plurality of display screens, comprising:

a single display screen having a first display portion corresponding to a first display screen of the associated multi-layer display device, the first display portion containing a first visual image, and a second display portion corresponding to a second display screen of the associated multi-layer display device, the second display portion containing a second visual image, wherein the first display portion and second display portion combine to form a combined single plane visual image, said combined single plane visual image including the first display portion to be displayed on the first display screen and the second display portion to be displayed on the second display screen of the associated multi-layer display device, and wherein the first and second display screens are positioned along a common line of sight that passes through a portion of the first and second display screens such that a person may perceive actual depth between the first and second visual images displayed on the first and second display screens of the associated multi-layer display device; and a logic device in communication with the single display screen and the associated multi-layer display device, the logic device configured to facilitate coordination and synchronization of the first and second visual images displayed on the multi-layer display device and to receive and process the combined single plane visual image for three-dimensional display on said first and second display screens of the associated multi-layer display device.

2. The display system of claim 1, wherein the combined single plane visual image has a resolution equal to the sum of a first resolution of the first display screen of the associated multi-layer display device and a second resolution of the second display screen of the associated multi-layer display device.

3. The display system of claim 1, wherein the first display portion is positioned in a substantially side-by-side orientation adjacent to the second display portion on the single display screen.

4. The display system of claim 3, further comprising a pointer configured to be displayed on the first display screen, the pointer further configured to be moved a first distance in a horizontal direction and a second distance in a vertical direction, wherein the first distance is reduced by a ratio of a horizontal component of the first resolution and a horizontal component of the resolution of the combined single plane visual image.

5. The display system of claim 1, wherein the first portion is positioned above or below the second portion on the single display screen.

6. The display system of claim 5, further comprising a pointer configured to be displayed on the first display screen, the pointer further configured to be moved a first distance in a horizontal direction and a second distance in a vertical direction, wherein the second distance is reduced by a ratio of a vertical component of the first resolution and a vertical component of the resolution of the combined single plane visual image.

7. The display system of claim 1, further comprising:

a third display portion corresponding to a third display screen of the multi-layer display device, wherein the combined single plane visual image data further comprises a third visual image contained in the third display portion and displayed on the third display screen.

8. A method for presenting images in a multi-layer display device having a first display screen and a second display screen, the second display screen arranged relative to the first display screen such that a common line of sight passes through a portion of the first display screen to a portion of the second display screen such that a person may perceive actual depth between visual images displayed on the first and second display screens, the method comprising:

creating a combined single plane image on a single display screen, the single plane image having a first image portion to be displayed on the first display screen and a second image portion to be displayed on the second display screen of the multi-layer display device;

transmitting the first image portion to the first display screen via a single logic device; and transmitting the second image portion to the second display screen via said single logic device, said single logic device configured to facilitate coordination and synchronization of the first and second visual image portions displayed on the multi-layer display device.

9. The method of claim 8, further comprising setting a resolution of the combined single plane image to a sum of a first resolution of the first display screen and a second resolution of the second display screen.

10. The method of claim 8, further comprising positioning the first image portion in a substantially side-by-side orientation adjacent the second image portion.

11. The method of claim 10, further comprising:

receiving an input indicating movement of a pointer on one of the first or second display screens a first distance in a horizontal direction and a second distance in a vertical direction;

reducing the first distance by multiplying the first distance by a ratio of a horizontal component of the first resolution and a horizontal component of the resolution of the combined single plane image; and displaying the pointer at the new location based upon the reduced first distance.

12. The method of claim 8, further comprising positioning the first image portion above or below the second image portion.

13. The method of claim 12, further comprising:

receiving an input indicating movement of a pointer on one of the first or second display screens a first distance in a horizontal direction and a second distance in a vertical direction;

reducing the second distance by multiplying the second distance by a ratio of a vertical component of the first resolution and a vertical component of the resolution of the combined single plane image; and displaying the pointer at the new location based upon the reduced second distance.

14. An apparatus for presenting images in a multi-layer display device, comprising:

a first display screen having a first resolution and adapted to present a first visual image thereon;

a second display screen having a second resolution and adapted to present a second visual image thereon, the second display screen arranged relative to the first display screen such that a common line of sight passes through a portion of the first display screen to a portion of the second display screen such that a person may perceive actual depth between the first and second visual images displayed on the first and second display screens;

means for creating a combined single plane image on a single display screen, the combined single plane image having a first image portion to be displayed on the first display screen and a second image portion to be displayed on the second display screen of the multi-layer display device; and logic means for facilitating coordination and synchronization of the first and second visual image portions displayed on the multi-layer display device, said logic means capable of transmitting the first image portion to the first display screen, and said logic means capable of transmitting the second image portion to the second display screen.

15. The apparatus of claim 14, further comprising means for setting a resolution of the combined single plane image to a sum of the first resolution and the second resolution.

16. The apparatus of claim 14, further comprising means for positioning the first image portion in a substantially side-by-side orientation adjacent the second image portion.

17. The apparatus of claim 16, further comprising:

means for receiving an input indicating movement of a pointer on one of the first or second display screens a first distance in a horizontal direction and a second distance in a vertical direction;

means for reducing the first distance by multiplying the first distance by a ratio of a horizontal component of the first resolution and a horizontal component of the resolution of the combined single plane image; and means for displaying the pointer at the new location based upon the reduced first distance.

18. The apparatus of claim 14, further comprising means for positioning the first image portion above or below the second image portion.

19. The apparatus of claim 18, further comprising:

means for receiving an input indicating movement of a pointer on one of the first or second display screens a first distance in a horizontal direction and a second distance in a vertical direction;

means for reducing the second distance by multiplying the second distance by a ratio of a vertical component of the first resolution and a vertical component of the resolution of the combined single plane image; and means for displaying the pointer at the new location based upon the reduced second distance.

20. A method for determining a new location of a pointer on a multi-layer display device having a first display screen and a second display screen, the second display screen arranged relative to the first display screen such that a common line of sight passes through a portion of the first display screen to a portion of the second display screen such that a person may perceive actual depth between visual images displayed on the first and second display screens, the method comprising:

displaying a combined single plane image on the first display screen and the second display screen via a single logic device, wherein the combined single plane image has a first image portion to be displayed on the first display screen and a second image portion to be displayed on the second display screen of the multi-layer display device, and wherein said single logic device is configured to facilitate coordination and synchronization of the first and second image portions displayed on the multi-layer display device;

receiving an input from an input device indicating movement of the pointer displayed on the first video display screen a first distance in a horizontal direction and a second distance in a vertical direction;

reducing either the first or second distance by multiplying the first or second distance by a ratio of a first display screen resolution and a combined image resolution; and displaying the pointer at the new location based upon the reduced first or second distance.

21. The method of claim 20, further comprising reducing a speed of the pointer by multiplying the speed by a ratio of the first display resolution and the combined single plane image resolution.

22. The method of claim 20, wherein the first distance is reduced if the first image portion is positioned in a substantially side-by-side orientation adjacent the second image portion.

23. The method of claim 20, wherein the second distance is reduced if the first image portion is positioned above or below the second image portion.

24. A gaming machine, comprising:

a first display screen having a first resolution and adapted to present a first visual image thereon;

a second display screen having a second resolution and adapted to present a second visual image thereon, the second display screen arranged relative to the first video display screen such that a common line of sight passes through a portion of the first display screen to a portion of the second display screen such that a person may perceive actual depth between the first and second visual images displayed on the first and second display screens; and a logic device configured to communicate with the first display screen and the second display screen and configured to receive a combined single plane visual image for display on the first and second display screen, the combined visual image having a first portion to be displayed on the first display screen and a second portion to be displayed on the second display screen, wherein the logic device is configured to transmit the first visual image to the first display screen and the second visual image to the second display screen.

25. The gaming machine of claim 24, wherein the single combined visual image has a resolution equal to the sum of the first resolution and the second resolution.

26. The gaming machine of claim 24, wherein the first portion is positioned in a substantially side-by-side orientation adjacent to the second portion.

27. The gaming machine of claim 26, further comprising a pointer configured to be displayed on the first display screen, the pointer further configured to be moved a first distance in a horizontal direction and a second distance in a vertical direction, wherein the first distance is reduced by a ratio of a horizontal component of the first resolution and a horizontal component of the resolution of the combined visual image.

28. The gaming machine of claim 24, wherein the first portion is positioned above or below the second portion.

29. The gaming machine of claim 28, further comprising a pointer configured to be displayed on the first display screen, the pointer further configured to be moved a first distance in a horizontal direction and a second distance in a vertical direction, wherein the second distance is reduced by a ratio of a vertical component of the first resolution and a vertical component of the resolution of the combined visual image.

30. The gaming machine of claim 24, wherein the logic device is a video card having a plurality of output ports.

31. A system for displaying images on a multi-layer display device, comprising:

a first display screen having a first resolution and adapted to present a first visual image thereon;

a second display screen having a second resolution and adapted to present a second visual image thereon, the second display screen arranged relative to the first display screen such that a common line of sight passes through a portion of the first display screen to a portion of the second display screen such that a person may perceive actual depth between the first and second visual images displayed on the first and second display screens; and a logic device configured to communicate with the first display screen and the second display screen and configured to receive a combined single plane visual image for display on the first and second display screen, the combined visual image having a first portion to be displayed on the first display screen and a second portion to be displayed on the second display screen of the multi-layer display device, wherein the logic device is configured to facilitate coordination and synchronization of the first and second visual images displayed on the multi-layer display device and to transmit the first visual image to the first display screen and the second visual image to the second display screen.

32. The system of claim 31, wherein the combined single plane visual image has a resolution equal to the sum of the first resolution and the second resolution.

33. The system of claim 31, wherein the first portion is positioned in a substantially side-by-side orientation adjacent to the second portion.

34. The system of claim 33, further comprising a pointer configured to be displayed on the first display screen, the pointer further configured to be moved a first distance in a horizontal direction and a second distance in a vertical direction, wherein the first distance is reduced by a ratio of a horizontal component of the first resolution and a horizontal component of the resolution of the combined single plane visual image.

35. The system of claim 31, wherein the first portion is positioned above or below the second portion.

36. The system of claim 35, further comprising a pointer configured to be displayed on the first display screen, the pointer further configured to be moved a first distance in a horizontal direction and a second distance in a vertical direction, wherein the second distance is reduced by a ratio of a vertical component of the first resolution and a vertical component of the resolution of the combined single plane visual image.

37. The system of claim 31, wherein the logic device is a video card having a plurality of output ports.

* * * * *